US007497546B2

(12) United States Patent
Nakashima et al.

(10) Patent No.: US 7,497,546 B2
(45) Date of Patent: Mar. 3, 2009

(54) INK JET PRINTER

(75) Inventors: Atsuhisa Nakashima, Aichi-ken (JP); Susumu Kuzuya, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 274 days.

(21) Appl. No.: 11/275,298

(22) Filed: Dec. 22, 2005

(65) Prior Publication Data

US 2006/0139395 A1 Jun. 29, 2006

(30) Foreign Application Priority Data

Dec. 24, 2004 (JP) ..... 2004-372645

(51) Int. Cl.
*B41J 2/165* (2006.01)
*B41J 2/01* (2006.01)

(52) U.S. Cl. ..... 347/23; 347/104

(58) Field of Classification Search ..... 347/29, 347/32, 33, 104, 21, 23, 28; 400/624
See application file for complete search history.

(56) References Cited

U.S. PATENT DOCUMENTS 5,604,597 A * 2/1997 Imai ..... 358/296
6,325,559 B1 * 12/2001 Kaiser et al. ..... 400/624
6,511,152 B2 * 1/2003 Yoshimura ..... 347/33
2004/0119777 A1 6/2004 Nakashima et al.

FOREIGN PATENT DOCUMENTS

JP 1988162250 A 7/1988
JP 2001347651 A 12/2001
JP 2002046885 A 2/2002
JP 2002192751 A 7/2002
JP 2003170574 A 6/2003

OTHER PUBLICATIONS

European Search Report (4 pages) for (corresponding) European Patent Application No. 05258025, Mar. 28, 2006, Europe.

* cited by examiner

*Primary Examiner*—Shih-Wen Hsieh
(74) *Attorney, Agent, or Firm*—Baker Botts, LLP

(57) ABSTRACT

An ink jet printer is provided, which intermittently dispenses cleaning liquid onto ink that is adhered to an endless belt that carries printing sheets. A cleaning liquid dispenser is driven by a rotator that rotates in association with the rotation of the endless belt. The rotation position of the rotator is set as a reference, in order to control the feed timing. In this way, a gap can be maintained between two printing sheets that are carried by the endless belt, ink can be jetted toward the gap, and cleaning liquid can be dispensed on the gap. A print process and a flushing process can be sequentially repeated.

21 Claims, 16 Drawing Sheets

FIG. 5

| | Printing Sheet Length | Gap | At Reference Position Detection | | Carry Distance Data |
|---|---|---|---|---|---|
| | | | P2 | Distance from P2 to P1 | |
| A6 | 150 | 190 | 157.50 | 15.00 | 5.00 |
| A4 | 297 | 337 | 301.25 | 158.75 | 148.75 |
| A3 | 420 | 460 | 570.00 | 428.50 | 418.50 |

P1 Position 142.5mm

INK JET PRINTER

CROSS-REFERENCE TO RELATED APPLICATION

This application claims priority to Japanese Patent Application No. 2004-372645 filed on Dec. 24, 2004, the contents of which are hereby incorporated by reference into the present application.

BACKGROUND OF THE INVENTION

1. Field of the Invention

The present invention relates to an inkjet printer. More particularly, the present invention relates to an ink jet printer that executes a process that jets ink from nozzles in order to print and a process that jets ink from the nozzles in order to clean the nozzles, and has a function which cleans the ink that was jetted in order to clean the nozzles.

2. Description of the Related Art

An ink jet printer comprises a plurality of nozzles, and prints on a printing sheet by jetting ink from the nozzles. The diameters of the nozzles are extremely small, and there are times in which the nozzles will become clogged. Or, there may be times in which air bubbles become mixed with the ink, and thus the amount of ink jetted from the nozzles will be insufficient.

Accordingly, some ink jet printers will execute a process that jets ink from the nozzles in order to print, and a process that jets ink from the nozzles in order to recover or maintain the ability of the ink to be jetted from the nozzles. The later process will be referred to as a flushing process in the present specification. When the flushing process is executed, the clogs in the clogged nozzles can be cleared, and the ink having air bubbles mixed therein can be discharged. When the flushing process is executed at an appropriate timing, the ability of the ink to be jetted from the nozzles can be recovered or maintained, and the print quality can be maintained at a good level.

Some ink jet printers comprise an endless belt which serves to carry printing sheets. Some ink jet printers that execute the flushing process will jet ink toward the endless belt from the nozzles for the flushing process. If the ink is jetted toward the endless belt that is not covered with a printing sheet, the printing sheets will not become soiled due to the execution of the flushing process.

Ink jet printers that execute the flushing process by jetting ink from the nozzles toward the endless belt must clean the ink that has adhered to the endless belt. An ink jet printer that includes a cleaning mechanism for this purpose is disclosed in Japanese Laid-Open Patent Application Publication 2001-347651 (refer in particular to Paragraph 60 and FIG. 12).

The ink jet printer of this disclosure is provided with a pair of rollers between which an endless belt passes. Cleaning liquid is dispensed on the pair of rollers. When the endless belt passes through the pair of rollers, the cleaning liquid will be dispensed on the endless belt that contacts with the pair of rollers, and the ink adhered to the endless belt will be removed.

BRIEF SUMMARY OF THE INVENTION

When the flushing process is frequently performed, it will be possible to recover or maintain the ability of the ink to be jetted from the nozzles, by simply executing the flushing process for short periods of time. Accordingly, the present inventors created an ink jet printer that executes the flushing process each time printing is performed on one printing sheet. In this situation, because the flushing process will be completed in a short period of time, the area on the endless belt on which the ink jetted during the flushing process will adhere will be narrow. When two printing sheets are to be carried on the endless belt in a positional relationship in which a small gap is maintained therebetween during consecutive printing, the flushing process can be completed while ink is jetted toward that gap. According to this method, a printing process on one printing sheet is sequentially executed with the flushing process, and good print quality can be maintained thereby.

In this method, the ink that was jetted for the flushing process will adhere intermittently to the endless belt. In other words, there is a gap between the position on the endless belt to which the ink jetted for the previous flushing process is adhered, and the position on the endless belt to which the ink jetted for the next flushing process will be adhered, and thus the endless belt will not be soiled in that gap.

The technology disclosed in Japanese Laid-Open Patent Application Publication No. 2001-347651 dispenses the cleaning liquid continuously, rather than distinguishing between the position on the endless belt on which the ink is adhered and the position on which the ink is not adhered. The cleaning liquid is unnecessarily consumed in large quantities. In addition, a large cleaning liquid tank will be necessary, which will increase the size of the ink jet printer.

Accordingly, the inventors tried technology in which a valve is arranged in the dispensing flow path of the cleaning liquid, the valve is opened at the point in which a sensor detects that ink has adhered to the endless belt, and cleaning liquid is intermittently dispensed only at the locations in which ink is adhered.

However, the present inventors discovered that an increase in the carrying speed of the printing sheet or the endless belt (which limits the print speed) cannot be implemented in a system that opens and closes the cleaning liquid dispensing flow path with a valve, and that it is difficult to dispense cleaning liquid in locations in which ink has adhered.

The present invention serves to solve the aforementioned problems, and provides technology that accurately dispenses cleaning liquid in locations on an endless belt on which ink is adhered.

Prior to a detailed description of the present invention, an example shown in FIG. 10 will be described in order to improve understanding. In FIG. 10, the thickness of the printing sheet is exaggerated in order to easily distinguish the printing sheet from the endless belt that carries the printing sheet.

FIG. 10(8) illustrates a state in which a gap 202 maintained between two printing sheets 200*a*, 200*b* carried on an endless belt is placed opposite an ink jet head 204. A plurality of nozzles is formed on the lower surface of the ink jet head 204. FIGS. 10(9) and (10) show a state in which ink is jetted from the nozzles of the ink jet head 204 toward the gap 202 in order to execute the flushing process. The flushing process will be executed between the completion of the printing process with respect to the printing sheet 200*a* and the beginning of the printing process with respect to the printing sheet 200*b*. Reference numeral 206 of FIG. 10(10) shows ink that has adhered to the outer surface of the endless belt in the gap 202. Reference numeral 208 of FIG. 10(13) shows a cleaning liquid dispenser. FIG. 10(14) shows the cleaning liquid dispenser 208 intensively dispensing cleaning liquid on the ink 206 adhered to the outer surface of the endless belt. If the relationships shown in this example are repeatedly obtained, the cleaning liquid will not be consumed wastefully. Note that in FIG. 10, the printing sheet that has completed the printing process are shown as being carried along the endless belt, for ease of understanding; however, the printing sheet that has completed the printing process are actually separated from the endless belt, and discharged to a discharge position that is not shown in the figures.

In the example shown in FIG. 10, the state in which the cleaning liquid dispenser 208 dispenses cleaning liquid on the endless belt (the state shown in FIG. 10(14)), and the state in which the cleaning liquid dispenser 208 does not dispense cleaning liquid on the endless belt (the state shown in FIG. 10(13)), will be switched by a device that moves mechanically (a rotator 210 in this example). When mechanical movement is used to switch the state of the cleaning liquid dispenser 208, it becomes possible to match the position in which the ink 206 is adhered to the position in which the cleaning liquid is dispensed, even if the carry speed of the endless belt is fast.

An ink jet printer developed by the inventors comprises an endless belt for carrying at least one printing sheet, a pair of rollers for rotating the endless belt, an ink jet head for jetting ink towards the printing sheet being carried by the endless belt and towards the endless belt, a scraper for removing ink adhered to the endless belt, a cleaning liquid dispenser provided between the ink jet head and the scraper. The ink jet printer developed by the inventors further comprises a mechanical shifter that moves the dispenser between a first state in which the dispenser supplies the cleaning liquid onto the endless belt and a second state in which the dispenser does not supply the cleaning liquid onto the endless belt. The mechanical shifter is driven in association with the rotation of the endless belt.

In the example shown in FIG. 10, the dispenser 208 will be moved, by means of a mechanical shifter (e.g., the rotator 210), between the state shown in FIG. 10(14) in which it dispenses cleaning liquid on the endless belt, and the state shown in FIG. 10(13), in which it does not dispense cleaning liquid on the endless belt.

According to the ink jet printer of the present invention, the rotation of the endless belt will be mechanically synchronized with the movement of the mechanical shifter to switch the state of the dispenser. In this way, it will be possible to intensively dispense the cleaning liquid in a position in which ink has adhered, even if the carry speed of the endless belt is high. Wasteful consumption of the cleaning liquid can be prevented. In addition, a large cleaning liquid tank will be unnecessary, and the size of the ink jet printer can be reduced.

According to the ink jet printer of the present invention, cleaning liquid is dispensed on the ink adhered on the endless belt, and then a scraper will arrive at the position to strip off the ink. Because the ink will removed by the scraper in a state in which the ink is mixed together with the cleaning liquid on the endless belt, the ink will be skillfully removed from the endless belt.

Furthermore, because the dispensing operation of the cleaning liquid is mechanically synchronized with the rotation of the endless belt, the position in which the ink is adhered on the endless belt can be matched with the dispensing position of the cleaning liquid, and the cleaning liquid can be reliably dispensed in the necessary positions.

In addition, because the cleaning liquid is intermittently dispensed by a dispenser that mechanically moves in association with the rotation of the endless belt, even if the carry speed of the endless belt is high, the dispensing position of the cleaning liquid will not deviate from the expected position, and the cleaning liquid can be dispensed in an accurate position at an accurate timing.

When the operation of the cleaning liquid dispenser is controlled by an electrical device, e.g., when a position is detected on an endless belt on which ink is adhered, and the dispensing and stoppage of the cleaning liquid is controlled by opening and closing an electromagnetic value based upon that detected position, the electro-magnetic value must be opened and closed after the position at which ink is adhered was detected. Because the electromagnetic valve takes time to open and close, a situation will develop when the carry speed of the printing sheet is fast in which the electro-magnetic value cannot keep up with the pace of printing. When this occurs, problems such as the cleaning liquid being dispensed in a position that deviates from the position in which ink is adhered, and a loss of control in some situations, will be produced. Because the present device uses a mechanism that moves in association with the rotation of the endless belt in order to intermittently dispense cleaning liquid on the endless belt, these problems will not occur.

BRIEF DESCRIPTION OF THE DRAWINGS

FIG. 5 is a table which shows, for each size of printing sheet, a rear end position of a flushing region at a time when a reference position of a rotator was detected by a position detection sensor.

DETAILED DESCRIPTION OF THE INVENTION

Figure 1:
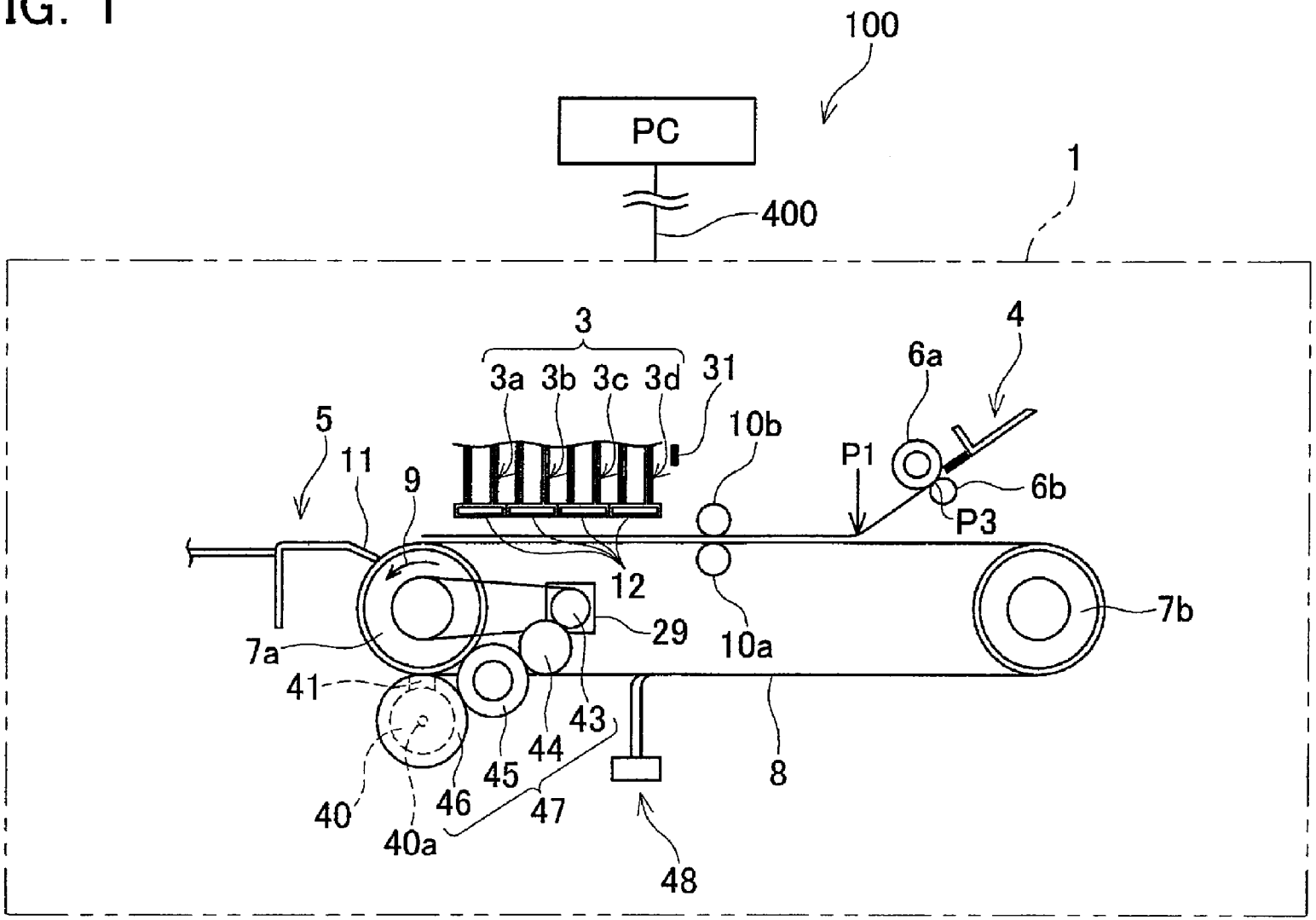
FIG. 1 is an outline view showing an embodiment of an ink jet printer of the present invention.

It is preferred that the ink jet head further comprises a feeder that feeds the printing sheet onto the outer surface of the endless belt. The feeder is activated so that consecutive printing sheets are aligned along the endless belt leaving a gap between the consecutive printing sheets. It is preferred that the ink jet head further comprise a driver that drives the ink jet head to jet ink towards the outer surface of the endless belt at the gap.

According to the aforementioned ink jet printer, when a plurality of printing sheets are carried by the endless belt, a gap will be maintained between two printing sheets, and the endless belt will be exposed at that gap.

Because a driver that jets ink toward the gap is installed, ink jetted from the nozzles in order to recover or maintain the ability of the nozzles to jet ink can be jetted toward the gap, and the flushing process can be performed without soiling the printing sheets. In addition, the print process and the flushing process can be sequentially and repeatedly executed.

By executing the flushing process at a high frequency, the print quality can always be maintained in a good state.

The dispenser preferably supplies the cleaning liquid onto the outer surface of the endless belt at the gap.

In this case, the cleaning liquid can be directly dispensed on the ink adhered to the endless belt. The cleaning liquid will thoroughly penetrate ink adhered to the endless belt. In addition, the ink can be scraped off with the scraper because the cleaning liquid and the ink are maintained in contact for a long period of time (the penetration time of the cleaning liquid). While being carried to the scraper, the ink can be placed into a state by the cleaning liquid which can be easily peeled from the endless belt. Ink removal can be simplified.

It is preferred that the mechanical shifter comprises a rotator that rotates in association with the rotation of the endless belt.

When the rotator is used, a mechanism that associates the operational state of the cleaning liquid dispenser with the rotation of the endless belt can be simply achieved.

It is preferred that a single common motor rotates both the endless belt and the rotator. When the drive source of the endless belt and the drive source of the rotator are separate, there is a possibility that the rotation of the endless belt and the rotation of the rotator will not match. When the endless belt and the rotator are rotated with a common motor, the rotation of the endless belt can be easily associated with the rotation of the rotator. When the drive source of the endless belt is separate from the drive source of the rotator, and the rotation of the endless belt is associated with the rotation of the rotator, a control means will be needed in order to coordinate the output of both drive sources. When a common motor is used, this type of control means can be made unnecessary, and the rotation of the endless belt can be associated with the rotation of the rotator with a simple device construction.

It is preferred that the rotator shifts the dispenser between a first position, where the dispenser contacts the outer surface of the endless belt; and a second position, where the dispenser is separated from the outer surface of the endless belt.

In this situation, a mechanism that intermittently dispenses cleaning liquid on a rotating endless belt can be achieved with a simple construction. Here, when the dispenser contacts the outer surface of the endless belt, it includes the situation in which both are in contact with each other via the ink. The cleaning liquid dispenser also achieves a function which removes the ink by contacting the endless belt. Ink can be more reliably removed because the ink can be removed in two steps by means of the dispenser and scraper.

It is preferred that the dispenser contacts the outer surface of the endless belt, at a place where an inner surface of the endless belts is supported by one of the rollers.

In this case, because the inner surface of the endless belt is supported by a roller, even when pressure is applied to the endless belt during the dispensing of the cleaning liquid, the endless belt can avoid being bent by the effects of the pressure. As a result, the taut state of the endless belt can be maintained in a steady state, and the phenomenon in which the carry speed of the printing sheet changes due to the dispensing of cleaning liquid can be avoided.

It is specifically preferred that the dispenser contacts the outer surface of the endless belt at a place where an inner surface of the endless belts is supported by a downstream side roller of the pair of rollers. The downstream side roller referred to here is the roller on the downstream side of the ink jet head, and is the roller positioned on the downstream side when observed along the carrying path of the printing sheets.

The endless belt beyond the ink jet head will contact the downstream side roller. When cleaning liquid is dispensed in the position in which the endless belt contacts with the downstream side roller, the cleaning liquid can be dispensed at a fast timing. In contrast, when cleaning liquid is dispensed in the position in which the endless belt contacts with the upstream side roller, the timing at which the cleaning liquid is dispensed will be delayed.

When cleaning liquid is dispensed in the position in which the endless belt contacts with the downstream side roller, the cleaning liquid can be dispensed before the ink has become too solidified.

It is preferred that the dispenser comprises a porous material that absorbs the cleaning liquid.

In this case, a mechanism that dispenses cleaning liquid to the dispenser, and dispenses cleaning liquid onto the endless belt from the dispenser, can be easily achieved.

It is preferred that the rotator is a cylindrical rotator, and the dispenser comprises a porous material extending on a peripheral surface of the cylindrical rotator, along a rotating axis of the cylindrical rotator. According to this structure, the porous material intermittently contacts the endless belt due to the rotation of the cylindrical rotator In this case, a dispenser and a mechanical shifter that switches the state of the dispenser can be achieved with a small number of parts and at low cost.

It is preferred that the ink jet printer further comprises a tank for storing the cleaning liquid. The tank may be provided below the cylindrical rotator so that the porous material is immersed into the cleaning liquid stored in the tank when the porous material is directed to the tank.

In this case, a mechanism that replenishes the cleaning liquid in the dispenser can be achieved with a small number of parts and at low cost.

It is preferred that the ink jet printer further comprises a main tank for storing the cleaning liquid. In this case, the main tank and the tank are connected by a tube and the tube is opened and closed by a valve.

In this case, because cleaning liquid for replenishment can be provided in a main tank, the tank itself can be reduced in size.

It is preferred that the main tank is positioned above the tank, and the cleaning liquid is transferred from the main tank to the tank, due to its gravity.

In this case, a device for transporting cleaning liquid from the main tank to the tank (e.g., a pump and the like) can be made unnecessary, and the overall cost of the device can be reduced.

It is also preferred that a pump is mounted between the main tank and the tank.

In this case, the degree of freedom to provide a main tank can be increased. In other words, it is preferable that the tank be arranged in the vicinity of the endless belt, and in particular, the tank must be provided in the vicinity of the endless belt when the cleaning liquid dispenser contacts the endless belt to dispense cleaning liquid on the endless belt. However, because a main tank that is arranged separately from the tank can dispense cleaning liquid to the tank via a cleaning liquid flow path, there is a high degree of freedom in the arrangement position. As a result, the main tank can be provided in a position that a worker can deal with. The ease with which the cleaning liquid is replaced, and the ease with which the main tank can be replaced, can both be improved.

It is also preferred that the rotator may be a rotating cam, and the dispenser is shifted between the first position and the second position by the rotation of the rotating cam.

In this case, because the rotator and the dispenser can be formed separately, the maintenance and repair thereof can be performed separately.

It is also preferred that the dispenser comprises a cylinder, a piston that slides within the cylinder and a cranking mechanism, and the rotator is coupled to the rotating mechanism.

In this case, the cleaning liquid dispenser need not contact the endless belt. The cleaning liquid can be dispensed on the endless belt without contact. Because of this, the cleaning liquid dispenser need not have ink-proof and soil-proof properties.

It is preferred that the ink jet printer further comprises an angle detector for detecting a rotating angle of the rotator, and a feeder that feeds the printing sheet onto the outer surface of the endless belt. The feeder is activated based on a timing when the angle detector detects a predetermined angle of the rotator.

In this case, the position on the endless belt on which the dispenser dispenses cleaning liquid, and the position of the printing sheets on the endless belt that are fed by the feeder can be adjusted to a fixed positional relationship. The printing sheets can be fed to a position adjacent to the dispensing position of the cleaning liquid. When there is no wasted time between the flushing process and the print process, it will be possible to sequentially repeat both processes.

It is preferred that the feeder is activated based on a timing when the endless belt is rotated for a predetermined distance from a position when the angle detector detected the predetermined angle of the rotator.

In this case, the position on the endless belt on which the dispenser dispenses cleaning liquid, and the position of the tips of printing sheets on the endless belt that are fed by the feeder can be adjusted to a fixed positional relationship. The printing sheets can be fed to a position adjacent to the dispensing position of the cleaning liquid. When there is no wasted time between the flushing process and the print process, it will be possible to sequentially repeat both processes.

It is preferred that the predetermined distance is selected based on a size of the printing sheet.

In this case, regardless of the size of the paper, the position on the endless belt on which the dispenser dispenses cleaning liquid, and the position of the printing sheets on the endless belt that are fed by the feeder, can be adjusted to a fixed positional relationship. The printing sheets can be fed to a position adjacent to the dispensing position of the cleaning liquid.

It is preferred that the a speed changer is provided between the motor and the rotator. A speed change ratio of the speed changer may be switched based on a size of the printing sheet.

In this case, the rotator can be rotated at a rotation speed that corresponds to the length of a printing sheet in the carrying direction. As a result, even if the timing at which ink is jetted on the endless belt is changed due to a change in the size of the printing sheet (the length in the carrying direction), the rotation speed of the rotator corresponding thereto can be changed, i.e., the operational period of the cleaning liquid dispenser can be coordinated in accordance with the size of the printing sheet. Because of this, even if the gap of ink jetted on the endless belt is changed due to a change in the size of the printing sheet, the cleaning liquid can be dispensed at an accurate timing in accordance with that gap.

It is especially preferred that the speed changer is selected so that the endless belt runs a predetermined distance while the rotator rotates 360 degrees. The above predetermined distance is equal to a sum of a length of the printing sheet and a fixed length. The fixed length is equal or slightly longer than the portion to which the cleaning liquid is supplied.

Its is also preferred that the ink jet printer comprises a sheet sensor that detects whether the printing sheet exists or not at a predetermined position. The ink jet head is activated based on a detected result by the sheet sensor In this case, ink for the flushing process can be jetted toward a position in which there is no printing sheet, i.e., the gap between two printing sheets.

It is also preferred that the ink jet printer comprises rotation position detection means that detects the rotation position of the rotator, and a timing control means that controls the timing at which printing sheet is fed onto the endless belt, and the timing at which ink is jetted from the nozzles, based upon the rotation position of the rotator detected by the rotation position detection means.

In this case, printing sheets can be fed onto the endless belt at an accurate timing, and ink can be jetted at an accurate timing in order to recover or maintain the jetting ability of the nozzles. In other words, the timing at which the rotator places the cleaning liquid dispenser in the first state can be known by detecting the rotation position of the rotator. In addition, because the movement of the endless belt is synchronized with the rotation of the rotator, the current position of the spot on the endless belt that will arrive at the cleaning liquid dispensing position at the aforementioned timing will be clear. By controlling the timing of the jetting of the ink based upon the rotation position of the rotator detected by the rotation position detection means, ink can be jetted at the spot on the endless belt that will arrive in the cleaning liquid dispensing position at the time that the cleaning liquid dispenser is placed in the first state. In addition, printing sheets can be feed onto the endless belt at positions on which ink is not to be jetted.

The length of the adhering location in the carrying direction on which ink jetted onto the endless belt is adhered, the length of the printing sheet in the carrying direction, and the feeding position in which the printing sheet is fed onto the endless belt, are determined in advance. The length of a printing sheet in the carrying direction combined with the length of the adhering location in the carrying direction can be defined as one section. A printer of the present invention comprises a judging means that judges whether or not the adhering position provided within that section is provided in a position that faces the ink jet head, and carrying data storage means that stores carry distance data. The carry distance data is the position of the end of the section though which the ink jet head will pass next, and is calculated from the position of the end of the section at the time that the rotation position of the rotator was detected, and the feed position. The printer of the present invention comprises a jetting ability recovery/maintenance means. The jetting ability recovery/maintenance means will execute ink jetting when it is determined by the judging means that the adhering location is provided in a position facing the ink jet head. The printer of the present invention comprises a rotator drive control unit. The rotator drive control unit will control the driving of the rotator, so that the transition period to the first state of the cleaning liquid dispenser will be the carry time in which the section is carried by the endless belt or less, and the measured carry time. The printer of the present invention comprises a timing control means. When the rotation position is detected by the rotation position detection means, the timing control means will control the operational timing of a feed device based upon the carry distance data stored by the carry data storage means, so that a new printing sheet will be provided to the feed position at the time that the end of the section that the ink jet head passes through next passes through the feed position. Note that the term "adhering location" indicates a location designated as the region in which ink will be jetted, and when an excessive portion that is wider than the portion in which ink is actually adhered is designated, a region which equals the portion to which ink is actually adhered and the excessive portion will be defined as the adhering location.

In the aforementioned case, the feeding operation of the printing sheets, and the ink jetting operation by the jetting ability recovery/maintenance means, can be reliably executed in the rotator period, i.e., the timing of the transition period to the first state of the cleaning liquid dispenser. In this way, printing sheets can provided on the endless belt at a gap that corresponds to the transition period to the first state of the cleaning liquid dispenser, and ink can be jetted onto the endless belt by the jetting ability recovery/maintenance means while avoiding the position in which the printing sheets are provided. Thus, in situations such as when images are consecutively formed on a plurality of printing sheets, even if printing sheets are carried in succession, the adhering position of the ink jetted on the endless belt and the feed position of the printing sheets will be controlled in accordance with the transition period to the first state of the cleaning liquid dispenser. The adhering position of the ink and the cleaning liquid dispensing position can be matched, and the adhering position of the ink will not deviate from the position in which the printing sheets are provided.

The printer comprises a rear end detection means that detects the rear end of a printing sheet, and when images are to be formed on a plurality of printing sheets, the first printing sheet preferably controls the timing of the feed based on the rotation position of the rotator detected by the rotation position detection means, and the second printing sheet and thereafter is preferably fed at the moment that the rear end of the printing sheet that was fed earlier is detected by the rear end detection means. In this way, identical gaps can be formed along the length of the adhering location in the carry direction, between the front end of the printing sheet that will be fed next and the rear end of the previous printing sheet.

In the aforementioned case, the initial printing sheet amongst a plurality of printing sheets to be carried will control the timing of the feed based upon the rotation position of the rotator detected by the rotation position detection means. Thereafter, the printing sheets will be fed at the timing at which the rear ends of the printing sheets are detected by the rear end detection means. In this way, the printing sheet feed can be executed at a timing that is in accordance with the transition period, to the first state of the cleaning liquid dispenser.

Preferred embodiments of the present invention will be described with reference to the attached drawings. FIG. 1 is an overview showing an ink jet printer 1 (hereinafter referred to as "printer 1") that is one embodiment of the present invention. This printer 1 is connected via a communication cable 400 to a personal computer 100 (hereinafter referred to as "PC 100"), and performs printing based upon print data transmitted from the PC 100. Note that in addition to the communication cable 400, a wireless LAN module such as WiFi and the like can be adopted as a communication means that will output print data and the like from the PC 100 to the printer 1

The printer 1 is a color ink jet printer having a color ink jet head 3, and the ink jet head 3 comprises four ink jet heads (first to fourth heads 3*a*-3*d*) that respectively correspond to cyan, magenta, yellow, and black inks.

The first to fourth heads 3*a*-3*d* are respectively formed into substantially rectangular shapes when viewed in cross-section, and both extend lengthwise along a direction that is perpendicular to the carry direction of the printing sheet (the width direction of the printing sheet), and are positioned nearby each other. In addition, each of the first to fourth heads 3*a*-3*d* respectively has a head unit 12, on the lower ends thereof. The head units 12 extend lengthwise along a direction that is perpendicular to the carry direction of the printing sheet, and the lower surfaces thereof are provided so as to face the outer peripheral surface of an endless belt 8. Note that the length of each head unit 12 along the carry direction of the printing sheet is approximately 10 mm, and the adjacent head units 12 mutually contact with the peripheral surfaces thereof. A large number of nozzles having extremely small diameters are arranged on the lower surfaces of the head units 12 along the lengthwise direction of the head units 12, so as to extend across the entire width of a printing sheet to be carried. This printer 1 is a line type printer.

Note that the first to fourth heads 3*a*-3*d* may be positioned in the aforementioned position when a print operation and a flushing operation to be described below are performed, or may be moved to another position in situations other than this.

An ink jet printer will execute a flushing process that jets ink from the nozzles, except during a print operation, in order to maintain or recover the ability of ink to be jetted from the nozzles. This flushing process will eliminate nozzle clogging that is caused by dried ink, and will discharge air bubbles that have been mixed into the ink In the present embodiment, ink will be jetted from the nozzles onto the endless belt 8 during the flushing process. Cleaning liquid will be dispensed from a sponge member 41 (described below) onto the ink that was jetted onto the endless belt during the flushing process. Mixture of the leaning liquid and ink will be removed by a blade 48, and will be cleared from the endless belt 8. Because means for cleaning ink jetted onto the endless belt 8 is provided, the flushing process can be executed without retracting the ink jet head 3 from above the endless belt 8. In the past, a maintenance unit for receiving ink jetted from the nozzles was interposed between the lower surfaces of the head units 12 and the endless belt 8. In this case, a mechanism was needed to move the endless belt 8 (the belt rollers 7*a*, 7*b*, and the like) downward from the head units 12. In the present embodiment, vertical movement of the endless belt 8 is not necessary. In the present embodiment, a large mechanism for moving the ink jet head 3 or the endless belt 8, and the retraction space therefore, can be rendered unnecessary, and thus the size of the printer 1 can be reduced.

The head units 12 are provided so that a small gap is formed between the lower surfaces thereof and the carry surface of the endless belt 8, and the printing sheet carry path is formed in this gap portion. When printing sheets carried by the endless belt 8 pass directly below the 4 head units 12, a desired color image can be formed on the printing sheets by jetting ink drops of each color from the nozzles toward the upper surfaces of the printing sheets, i.e., the print surfaces.

In addition, a feed tray 4 is provided in the printing sheet carry path more upstream (to the right in FIG. 1) than the ink jet head 3. The feed tray 4 is formed so that a plurality of printing sheets can be supplied, and a pair of feed rollers 6*a*, 6*b* are provided immediately downstream of the feed tray 4. The printing sheets supplied by the feed tray 4 are grasped and carried by the feed rollers 6*a*, 6*b*, are sent from the right side in the figure to the left side, and are fed to a predetermined feed position P1 on the endless belt 8. Note that the present embodiment is constructed so that the distance from the feed position P1 to a nip point P3 of the feed rollers 6*a*, 6*b* is 10 mm. In addition, the pre-fed printing sheet (the printing sheet to be fed next) stand by in a state in which the front end thereof is provided at the nip point P3. When feed initiation is ordered, the feed rollers 6*a*, 6*b* are driven, the front end of the printing sheet is carried 10 mm from the nip point P3, and will arrive on the endless belt 8 at the feed position P1.

Pressing rollers 10*a*, 10*b* that are constructed with a pair of roller members are provided on the upstream side of the ink jet head 3, and more downstream than the feed position P1. The pressing member 10*a* is below the endless belt 8, and the pressing member 10*b* is provided above the endless belt 8. The pressing member 10*a*, 10*b* serve to press printing sheets to the carry surface of the endless belt 8 and reliably adheres them to the carry surface, so that the printing sheets on the endless belt 8 do not lift up from the carry surface. In addition, a paper sensor 31 that serves to detect the presence or absence of a printing sheet is provided above the endless belt 8 and between the ink jet head 3 and the pressing member 10*b*. The paper sensor 31 is constructed with a reflection type light sensor comprised of a photoemission element and a photoreceptor element. A photoemission diode is used in the photoemission element, and a phototransistor is used in the photoreceptor. The paper sensor 31 uses a change in the amount of light (reflectance ratio) received due to the presence or absence of a printing sheet to detect the presence or absence of a printing sheet. The time at which the front end of a printing sheet has arrived will be detected by means of a large increase in the amount of received light, and time at which the rear end of a printing sheet has passed will be detected by a large reduction in the amount of received light.

The endless belt 8 is formed in an annular shape, and is wound so as to span between two belt rollers 7*a*, 7*b*. One belt roller 7*b* is provided on the upstream side of the ink jet head 3, and the other belt roller 7*a* is provided on the downstream side of the inkjet head 3. A silicone process is performed on the outer peripheral surface of the endless belt 8, i.e., the carry surface, and a printing sheet that is carried by the endless belt 8 will be held on the carry surface of the endless belt 8 by means of the adhesive force thereof. By rotatively driving the belt roller 7*a* on the downstream side in the counterclockwise direction (the direction of the arrow 9), a printing sheet will be carried toward the downstream side (the left side in FIG. 1). A carry motor (LE motor) 29 described below will rotate the belt roller 7*a* on the downstream side in the counterclockwise direction.

A printing sheet fed from the feed tray 4 to the endless belt 8 will be carried by the endless belt 8, will pass by a position facing the ink jet head 3 (the lower surface of the head units 12), and will arrive at a peeling mechanism 11. The peeling mechanism 11 is provided on the immediate downstream side of the endless belt 8 along the printing sheet carry path. The peeling mechanism 11 is constructed so as to peel the printing sheets adhered to the carry surface of the endless belt 8 from the carry surface of the endless belt 8, and feed printing sheets toward a paper discharge unit 5 on the downstream side (left side in FIG. 1) of the carry path.

The endless belt 8 will be conveyed along the belt roller 7*a* on the downstream side of the printing sheet carry path after carrying a printing sheet, and the lower side of the belt rollers 7*a*, 7*b* will be carried (returned) toward the belt roller 7*b* direction. Note that the belt rollers 7*a*, 7*b* are supported by a chassis not shown in the figures that is provided on the inner side of the endless belt 8.

A rotator 40 that is rotated by the carry motor (LF motor) 29 is arranged on the lower side of the belt roller 7*a*. The length of the rotator 40 is substantially the same as the length of the endless belt 8 in the direction perpendicular to the carry direction (the belt width). The lengthwise direction of the cylindrical rotator 40 is arranged so as to be parallel to the width direction of the endless belt 8. The torque of the LF motor 29 will be transmitted to the rotator 40, and a transmission unit 47 described below is linked thereto. Details of the transmission unit 47 will be described below with reference to FIG. 2. The rotator 40 is rotated in the clockwise direction around a shaft 40*a* as a rotation shaft, by means of the torque of the LF motor 29 that is transmitted by the transmission unit 47. The shaft 40*a* extends parallel to the belt roller 7*a*. Because the LF motor 29 rotates both the belt roller 7*a* and the rotator 40, the rotation of the belt roller 7*a* will be synchronized with the rotation of the rotator 40. In other words, the belt roller 7*a* and the rotator 40 will simultaneously start rotation and simultaneously stop rotation. In addition, the ratio value between the rotation speed of the belt roller 7*a* and the rotation speed of the rotator 40 can be selected, however when the ratio value is selected once, that value will be maintained. The term "synchronization" as used herein means maintaining the ratio of the rotation speed of the belt roller 7*a* to the rotation speed of the rotator 40 at a constant level. The LF motor 29 is used both as a drive source for the endless belt 8 and the drive source for the rotator 40

The shaft 40*a* of the rotator 40 projects from the end surface of the rotator 40, and extends until it contacts with a transmission plate 46 described below The end surface of the rotator 40 and the transmission plate 46 face each other across a gap.

A sponge member 41 is provided on one portion of the outer peripheral of the rotator 40 and formed in a convex shape outward from the outer peripheral surface thereof, in a straight line along the lengthwise direction of the column. A reference position for detecting the rotation position is arranged on the rotator 40, and the reference position is the position in which the center of the sponge member 41 in the column direction is arranged. In addition, the width of the sponge member 41 (the length along the circumferential direction of the rotator 40) is formed in a length that covers the area in which ink jetted by the flushing process is spread on the endless belt 8.

The sponge member 41 is impregnated with cleaning liquid that was dispensed from a tank 50 described below (see FIG. 3). In other words, the sponge member 41 retains the cleaning liquid by absorbing the same. When the rotator 40 is rotated around the shaft 40*a*, the sponge member 41 will be circumferentially moved along the outer peripheral surface of the rotator 40. The distance from the center of the rotator 40 to the outer periphery of the rotator 40 is different than the distance from the center of the rotator 40 to the surface of the sponge member 41 (the surface facing the belt roller 7*a*), and thus the sponge member 41 contact the belt roller 7*a* opposite thereto and pull away therefrom in response to the rotation position of the rotator 40. In other words, because the sponge member 41 is arranged on a portion of the outer peripheral surface of the rotator 40, the sponge member 41 will contact the belt roller 7*a* each time the rotator 40 completes one rotation. In other words, the sponge 41 will sporadically or intermittently contact the endless belt 8.

In a state in which the sponge member 41 contacts the outer peripheral surface of the rotator 40 (the time period from when one end of the sponge member 41 in the circumferential direction contacts the endless belt 8, to when the other end thereof in the circumferential direction separates from the endless belt 8), cleaning liquid will be sporadically or intermittently dispensed on the endless belt 8 because the cleaning liquid will be dispensed on the endless belt 8 by the sponge member 41. Note that the contact state of the sponge member 41 corresponds to the first state of the present invention. The state in which there is no contact corresponds to the second state of the present invention.

Figure 4:
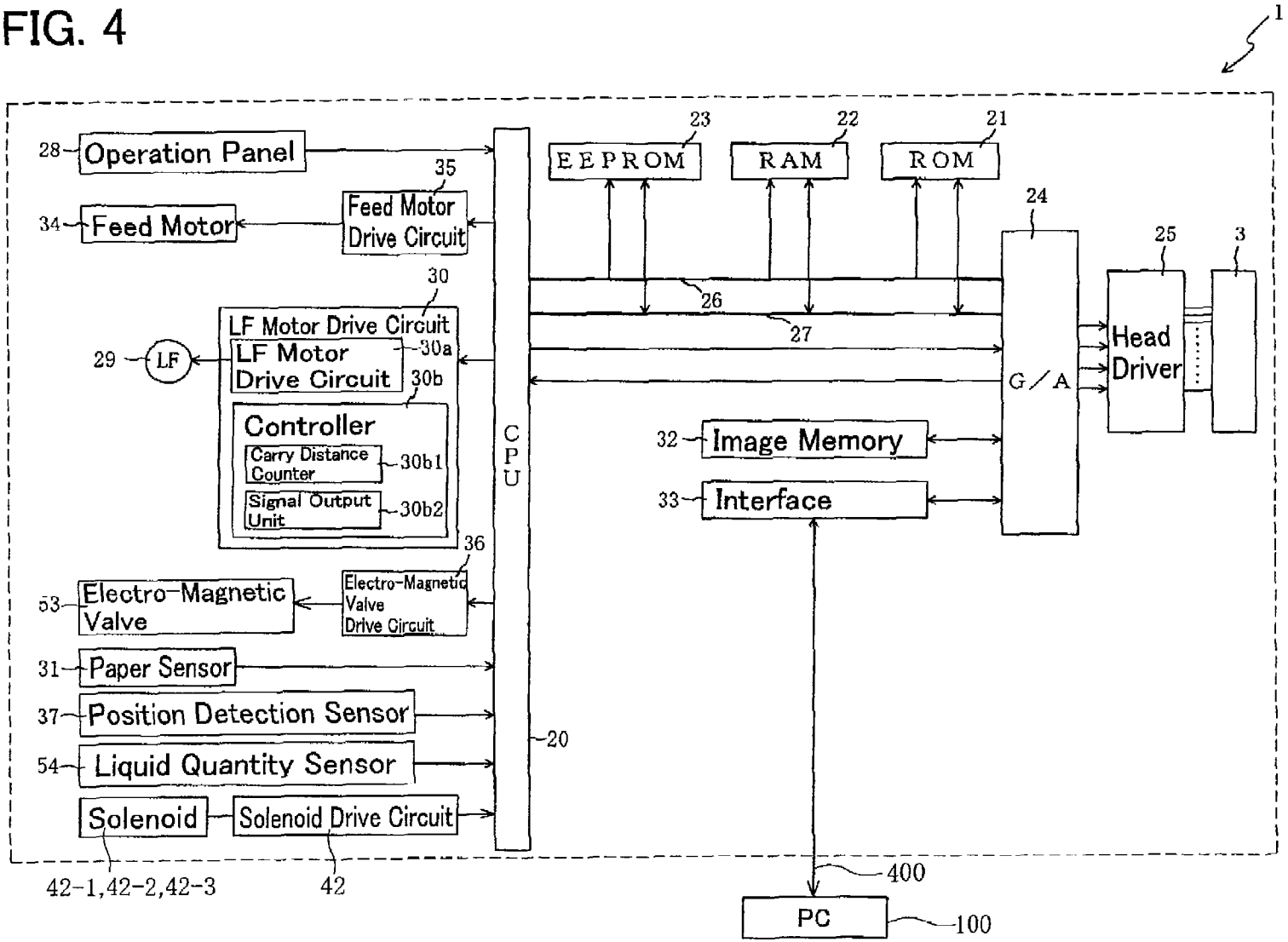
FIG. 4 is a block diagram showing the outline of the electrical circuit structure of the inkjet printer.

A position detection sensor 37 is arranged in a gap between the rotator 40 and the transmission plate 46 (see FIG. 4). The position detection sensor 37 comprises a flat disk member (not shown in the figures) that is formed into the same outer peripheral shape as the rotator 40 (the same shape in cross-section), and a light sensor (not shown in the figures).

The disk member is attached to the shaft 40*a* that extends from the rotator 40, and is integrally rotated with the rotator 40 by means of the rotation of the shaft 40*a*. A through hole that passes through the disk member is provided on the inner peripheral side of the disk member in a position corresponding to the reference position of the rotator 40. The through hole is provided at the same angle with the sponge member 41. When the sponge member 41 is rotated to the uppermost position, the through hole is also rotated to the uppermost position.

The light sensor is a transmission type light sensor comprised of a photoemission element and a photoreceptor. A light emitting diode is used in the photoemission element, and a phototransistor is used in the photoreceptor. The light sensor is arranged in a position that is rotated 90 degrees counterclockwise from the uppermost portion of the rotator 40. The intensity of the light received by the photoreceptor will differ when the through hole of the rotating disk member is in the sensor position and when it is not in the sensor position. The position detection sensor 37 will detect the time at which the through hole of the rotating disk arrives at a position rotated 90 degrees counterclockwise from the uppermost portion of the rotator 40. When the rotator 40 rotates 90 degrees more in clockwise from the timing when the detection sensor 37 detected the thorough hole, the thorough hole and the sponge member 41 are rotated to the uppermost position. The timing when the detection sensor 37 detected the thorough hole is termed as the reference timing.

The position detection sensor 37 is not limited to a device that detects the reference timing by means of light. A switch or the like that conducts electricity by contacting a conductor arranged on the detection position, or a variety of other widely known sensors, can be employed. In addition, as long as the rotation position of the rotator 40 can be detected, the reference position and the detection position are not limited to the locations described above, and may be arranged in any location.

The blade 48 for removing ink adhered to the endless belt 8 is arranged between the belt roller 7*a* and the belt roller 7*b*, further downstream in the carry direction of the endless belt 8 than the rotator 40. The blade 48 is formed from a resin having resistance to ink and the cleaning liquid, and is erected from below the endless belt 8 toward the endless belt 8, and the tip portion thereof is provided in a position that contacts the outer periphery of the returning endless belt 8. In addition, the blade 8 extends across the width of the endless belt 8, and the tip portion thereof is formed in a warped shape that is thinner than the other portions thereof. The tip side of the warp is curved on the downstream side in the carry direction with respect to the erection direction, so as to contact the endless belt 8. In this way, a predetermined width of the tip of the warp can contact with the endless belt 8, and the removed ink will be prevented from being carried further toward the downstream side in the carry direction than the blade 48.

In the present embodiment, the diameter of the belt roller 7*a* and the belt roller 7*b* is approximately 64 mm. The straight carry distance of the endless belt is approximately 200 mm, and the circumferential length of the endless belt is approximately 600 mm.

In the following, the distance is measured from origin point P0 shown in FIG. 6(*a*)). The origin P0 is an end point of a straight carry path of the endless belt 8 on the downstream side. The feed position P1 is separated from the origin P0 by 142.5 mm on the upstream side along the printing sheet carry path (the L direction of FIG. 6(*a*)). The tip of a printing sheet fed from the pair of feed rollers 6*a*, 6*b* will contact with the endless belt 8 at the feed position P1. The distance from a position P3 at which the pair of feed rollers 6*a*, 6*b* come into contact with a printing sheet to the feed position P1 is 10 mm.

As shown in FIG. 1, an approximately disk shaped transmission plate (not shown in the figures) is attached to the rotation shaft of the LF motor 29. The transmission plate is arranged in a position that is outward of the side end portion of the endless belt 8, and a groove is formed in the outer peripheral surface of the transmission plate. An endless drive belt extends between the transmission plate and the belt roller 7*a*. The LF motor 29 rotates the belt roller 7*a*, and carries the endless belt 8, by means of this transmission path.

Figure 2:
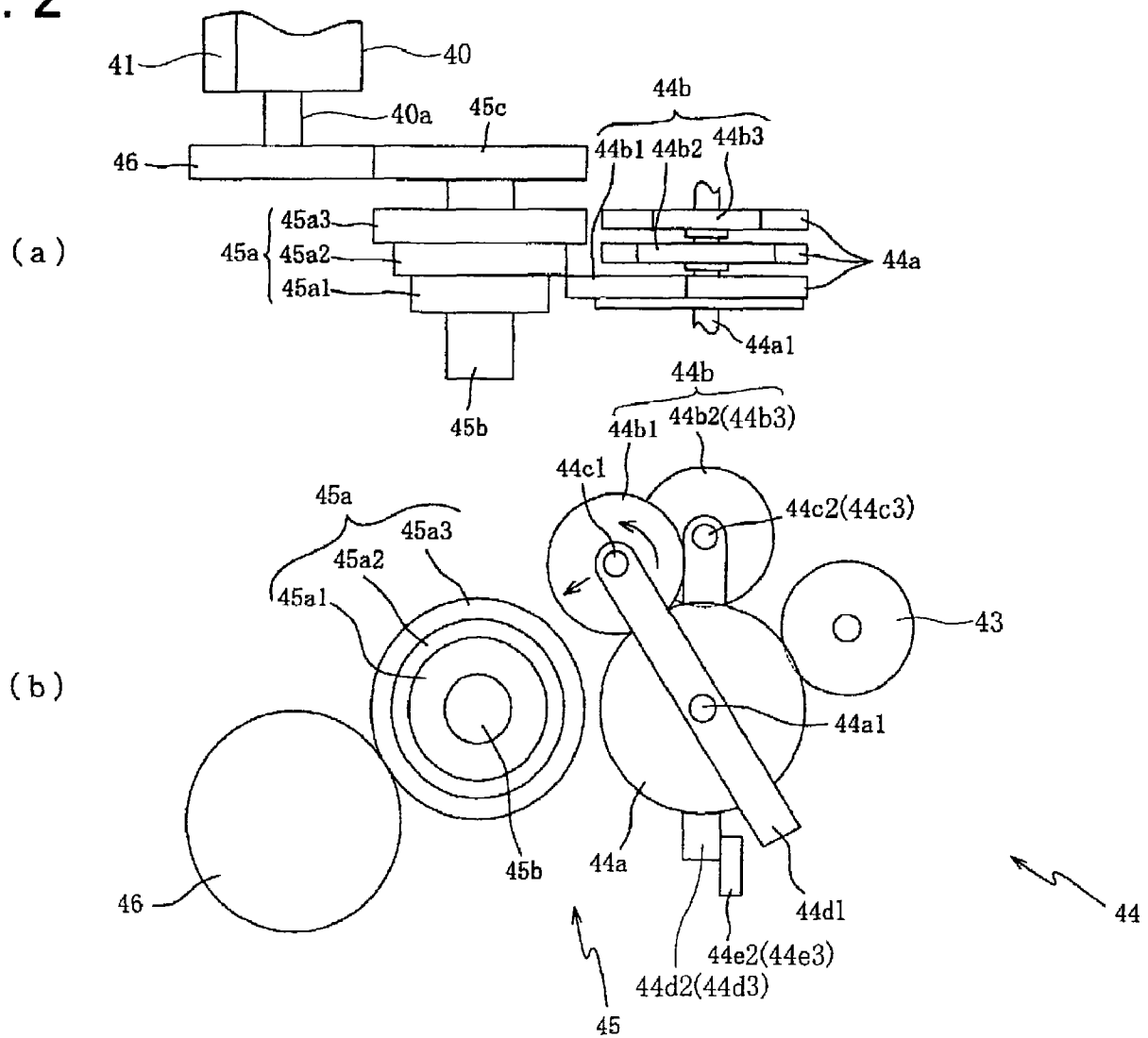
FIG. 2 (*a*) and (*b*) show the construction of a transmission unit.

A transmission unit for transmitting the moment (torque) of the LF motor 29 to the rotator 40 is arranged between the rotator 40 and the LF motor 29. The transmission unit 47 is a device that transmits the rotation (torque) of the LF motor 29 to the rotator 40, and primarily comprises a linking gear 43, a planetary gear mechanism 44, a speed change gear 45, and the transmission plate 46. FIG. 2 shows the construction of the transmission unit 47, with FIG. 2(*a*) showing a plan view of the transmission unit 47, and FIG. 2(*b*) showing a front view of the transmission unit 47. The linking gear 43 is attached to the rotation shaft of the LF motor 29. The linking gear 43 is provided on the outer side of the transmission plate (the near side in the plane of FIG. 1), and a plurality of gear teeth are arranged on the outer periphery thereof. The linking gear 43 is a device that transmits the torque of the LF motor 29 to the planetary gear mechanism 44, and is linked to the planetary gear mechanism 44.

The planetary gear mechanism 44 comprises three sun gears 44*a*, and three planet gears 44*b* (44*b*1-44*b*3) respectively arranged on the circumference of each sun gear 44*a*, and that respectively mesh with the sun gear 44*a*. The three sun gears 44*a* are attached so as to be concentric with the rotation shaft 44*a*1 that passes through the center of each sun gear 44*a* One sun gear 44*a* meshes with the aforementioned linking gear 43, will be integral with the rotation shaft 44*a*, and the three sun gears 44*a* will rotate at the same speed by the torque that is transmitted from the linking gear 43.

The planet gears 44*b* serve to switch the rotation speed of the rotator 40 (the rotation cycle) in response to the size of the printing sheet. The printer 1 can handle A3, A4, and A6 (photo printing sheet) size printing sheets. The three planet gears 44*b*1-44*b*3 are provided in order to handle three sheet sizes. In accordance with the rotation of the sun gear 44*a*, each planet gear 44*b* is constructed so as to rotate around the rotation shaft 44*c* of each planet gear 44*b* (hereinafter, this rotation will be referred to as axial rotation), while rotating around the sun gear 44*a* (hereinafter, this rotation will be referred to as orbital rotation).

The sun gears 44*a* and the planet gears 44*b* are linked by means of a fixing member 44*d* that extends in an imaginary line connecting the centers of the planet gears 44*b* and the centers of the sun gears 44*a*. Through holes are formed in the fixing member 44*d*, and the rotation shaft 44*c* of the planet gears 44*b* and the rotation shaft 44*a*1 of the sun gear 44*a* are rotatably fitted into those through holes. In addition, the end portion of the fixing member 44*d* that is on the opposite side of the planet gears 44*b* extends outward of the sun gears 44*a*, and that end portion will contact with a stopper member 44*e*.

Three stopper members 44*e* are provided, with each stopper member 44*e* corresponding to each planet gear 44*b* (44*b*1-44*b*3). Each stopper member 44*e* is respectively driven by a solenoid (shown in FIG. 4), and moves between a position that contacts with the end portion of the fixing member 44*d* and a position separated therefrom. When the stopper member 44*e* contacts the fixing member 44*d*, the planet gears 44*b* will be in a state in which they are retained directly above the sun gear 44*a*, the orbital rotation thereof will be restricted, and axial rotation will occur in that location. On the other hand, when the stopper member 44*e* is separated from the fixing member 44*d*, the restriction with respect to the orbital rotation of the planet gears 44*b* will be eliminated.

Each sun gear 44*a* will rotate in the counterclockwise direction, and each planet gear 44*b* (44*b*1-44*b*3) will orbitally rotate in the counterclockwise direction. When the stopper member 44*e* contacts the fixing member 44*d*, the planet gears 44*b* will be retained in a position directly above the sun gears 44*a*, the orbital rotation in the counterclockwise will be restricted thereinafter, and meshing with the speed change gears described below will be prohibited.

The speed change gear 45 is arranged in a position that contacts with the planet gears 44*b* that orbitally rotate in the counterclockwise direction. The speed change gear 45 is formed into spur gears 45*a* having a plurality of gear teeth arranged around their outer peripheries and which are stacked into 3 concentric levels. Each spur gear 45*a*1-45*a*3 is attached to a cylindrical drive shaft 45*b* formed to pass through the rotational centers thereof. Each respective spur gear 45*a*1-45*a*3 is provided in a position that respectively contacts one of the three planet gears 44*b*1-44*b*3. When any spur gear 45*a* meshes with the planet gears 44*b*, the three spur gears 45*a* will be rotated integrally with the drive shaft 45*b* by means of the torque transmitted from the planet gears 44*b*.

The spur gear 45*a*1 is set with a reduction ratio that will reduce the number of rotations transmitted by the planet gear 44*b*1 to the number of rotations that corresponds to an A6 size printing sheet. Likewise, the spur gear 45*a*2 is set with a reduction ratio that will reduce the number of rotations transmitted by the planet gear 44*b*2 to the number of rotations that corresponds to an A4 size printing sheet, and the spur gear 45*a*3 is set with a reduction ratio that will reduce the number of rotations transmitted by the planet gear 44*b*3 to the number of rotations that corresponds to an A3 size printing sheet.

In the present embodiment, ink will be jetted into 20 mm area in the carry direction of the endless belt 8 in order to perform the flushing process. A margin of 10 mm will be maintained on the upstream side of the ink jetting region, and a margin of 10 mm will be maintained on the downstream side thereof. Total of 40 mm area in the carry direction is set as the flushing region (the adhering location). In order to avoid the overlap of the flushing region and the printing sheet, a printing sheet that is A6 size will be fed each time the endless belt 8 rotates 190 mm (the 150 mm length of an A6 size printing sheet+the 40 mm length of the flushing region). If the printing sheet is A4 size, the printing sheet will be fed each time the endless belt 8 rotates 337 mm (the 297 mm length of an A4 size printing sheet+the 40 mm length of the flushing region). If the printing sheet is A3 size, the printing sheet will be fed each time the endless belt 8 rotates 460 mm (the 420 mm length of an A3 size printing sheet+the 40 mm length of the flushing region). Said another way, the flushing gap will be formed to be a 190 mm gap if the printing sheet is A6 size, a 337 mm gap if the printing sheet is A4 size, and a 460 mm gap if the printing sheet is A3 size. In order to dispense cleaning liquid on the ink that has been jetted onto the endless belt 8 at the aforementioned gaps, the reduction ratios of the spur gears 45*a*1-45*a*3 will be set so that the time that the endless belt 8 carries the aforementioned gap will match the rotation period in which the rotator 40 completes one rotation.

One end of the drive shaft 45*b* passes through the furthermost spur gear 45*a*3 of the spur gear 45*a* stacked in three levels, and an approximately disk shaped end plate 45*c* is attached to the end portion thereof, i.e., the end portion on the opposite side of the spur gear 45*a*1, so as to be concentric with the drive shaft 45*b*. The transmission plate 46 contacts the outer periphery of the end plate 45*c*.

The transmission plate 46 is formed in an approximate disk shape, and the rotator 40 is arranged on the rear surface of the transmission plate 46 (the upper side of FIG. 2(*a*)). The shaft 40*a* of the rotator 40 is fixed so as to be concentric with the axial center of the transmission plate 46. The rotator 40 will rotate integrally with the transmission plate 46 by means of the torque of the end plate 45*c*.

Due to the transmission mechanism 47, the torque of the LF motor 29 will be transmitted to one sun gear 44*a* of the planetary gear mechanism 44 via the linking gear 43, and the three sun gears 44*a* will be rotated counterclockwise in FIG. 2(*b*). Here, when a solenoid is driven, and one stopper member 44*e* that corresponds to the size of the printing sheet is operated, one planet gear (one of the planet gears 44*b*1-44*b*3) in which the restriction by the stopper member 44*e* has been eliminated will axially rotate in accordance with the rotation of the sun gear 44*a* while orbitally rotating in the counterclockwise direction, and will be moved in the direction of the speed change gear 45. Then, the planet gear will mesh with the spur gear 45*a* of the corresponding speed change gear, and the torque transmitted to the planet gear mechanism 44 by the linking gear 43 will be transmitted to the speed change gear 45. In this way, the end plate 45 attached to the drive shaft 45*b* will be rotated by the number of rotations that were changed by the speed change gear 45, and torque will be transmitted to the rotator 40 via the end plate 45*c* and the transmission plate 46. As a result, the torque of the LF motor 29 will be transmitted to the rotator 40. The transmission mechanism 47 will synchronize the period in which the rotator 40 makes one rotation, with the time in which the endless belt 8 moves the aforementioned gaps that were determined in accordance with the size of the printing sheets. In other words, when an A6 size printing sheet is printed with the printer 1, the sponge member 41 will contact the endless belt 8 each time the endless belt 8 is transported 190 mm, when an A4 size printing sheet is printed with the printer 1, the sponge member 41 will contact the endless belt 8 each time the endless belt 8 is transported 337 mm, and when an A3 size printing sheet is printed with the printer 1, the sponge member 41 will contact the endless belt 8 each time the endless belt 8 is transported 460 mm.

Figure 3:
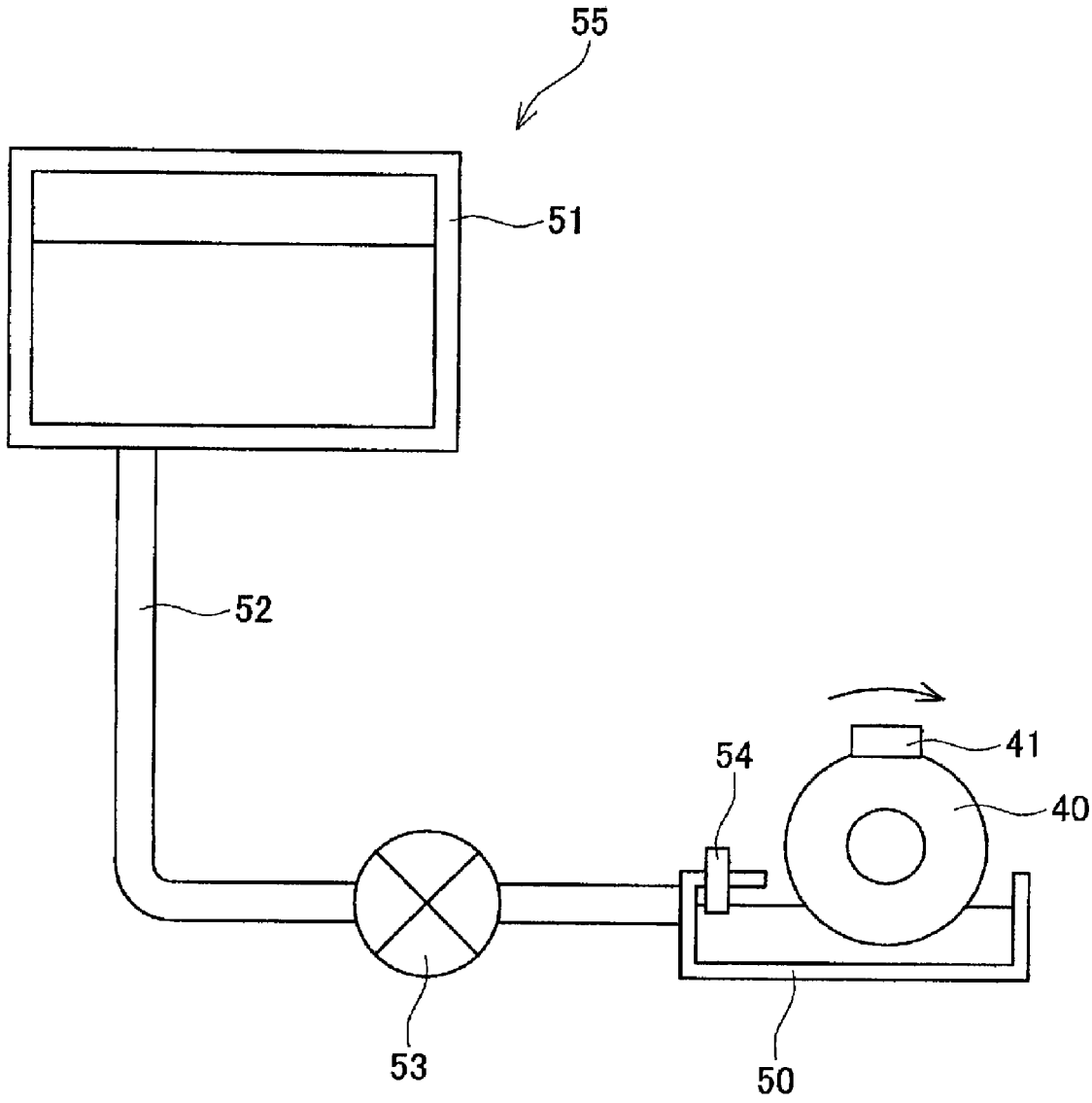
FIG. 3 shows the construction of a cleaning liquid dispenser in frame format.

FIG. 3 shows a cleaning liquid dispenser 55 in frame format that dispenses cleaning liquid to the rotator 40. The cleaning liquid dispenser 55 comprises a sub-tank 50 that stores cleaning liquid to be dispensed to the sponge member 41 arranged on the rotator 40. The sub-tank 50 is formed into a box shape with an ink-proof resin material. In addition, the sub-tank 50 is arranged in the circumferential trajectory of the sponge member 41 that is moved by means of the rotation of the rotator 40. The sponge member 41 will enter into the sub-tank 50 by means of the rotation of the rotator 40 and immersed in the cleaning liquid, and then will emerge from the opposite side of the side in which it entered. In this way, cleaning liquid will be periodically dispensed to the sponge member 41 from the sub-tank 50.

In addition, a liquid quantity sensor that serves to detect the quantity of cleaning liquid is arranged on the sub-tank 50. The liquid quantity sensor 54 will detect whether or not a predetermined quantity or greater of cleaning liquid is stored, by means of the change in electrical resistance between a state in which the liquid quantity sensor is immersed in the cleaning liquid and a state in which the liquid quantity sensor is not immersed in the cleaning liquid. When less than a predetermined quantity of cleaning liquid is detected by the liquid quantity sensor 54, cleaning liquid will be dispensed from a main tank 51 to the sub-tank 50.

The main tank 51 is arranged above the sub-tank 50, is detachably mounted on the main body of the printer 1, stores a large quantity of cleaning liquid, and dispenses cleaning liquid to the sub-tank 50 by means of the difference in the heads. The main tank 51 may be provided in any position inside the printer 1 so long as it is above the sub-tank 50, and thus is arranged in a position in which it can be easily accessed by an operator. When problems occur with the stored cleaning liquid (a deterioration in the quality, etc.), or the main tank 51 becomes empty, replenishment or the like of the cleaning liquid can be performed by replacing the main tank 51. Because of this, the replacement and replenishment of the cleaning liquid can be performed without handling the sub-tank 50, whose access is hindered by the rotator 40, the transmission unit 47, and the belt roller 7*a*. Moreover, the task of replacing or replenishing the cleaning liquid will be made easier, and thus workability can be improved.

The main tank 50 and the sub-tank 51 are connected by a hollow dispensing tube 51, and a cleaning liquid flow path from the main tank 51 to the sub-tank 50 is formed by means of the dispensing tube 51. An electromagnetic valve 53 that opens and closes the cleaning liquid flow path is arranged on the dispensing tube 52. The cleaning liquid flow path is opened by opening the electromagnetic valve 53, and the cleaning liquid stored in the main tank is dispensed to the sub-tank 50 due to the difference in the heads. In addition, the flow path of the cleaning liquid is cut by closing the electromagnetic valve, and the dispensing of the cleaning liquid from the main tank 51 to the sub-tank 50. Thus, because the cleaning liquid dispenser 55 of the present embodiment does not need a drive force to transmit the cleaning liquid, the printer 1 can be manufactured at low cost.

FIG. 4 is a block diagram showing an outline of the electrical circuit structure of the printer 1. The printer 1 is equipped with a microcomputer (CPU) 20 having a one chip construction, a ROM 21, a RAM 22, an EEPROM 23, a gate array (G/A) 24, a head driver 25, and the like. Note that the CPU 20, the ROM 21, the RAM 22, the EEPROM 23, the gate array 24, and the head driver 25 are connected together via an address bus 26 and a data bus 27.

The gate array 24 will output, in accordance with print timing signals output from the CPU 20, print data (drive signals) for printing image on a printing sheet, a transfer clock CLK that synchronizes the print data, latch signals, parameter signals for producing basic print waveform signals, and jet timing signals JET that are output at fixed cycle, based upon image data stored in an image memory 32. Each of these signals will be output to the head driver 25.

In addition, the gate array 24 stores print data transferred from the PC 100 via the interface 33 in the image memory 32.

The head driver 25 is a drive circuit that applies, in response to the signals output from the gate array 24, drive pulses having waveforms that match those signals to a drive actuator corresponding to each nozzle. The actuator will be operated by means of the drive pulses, and ink will be jetted from each nozzle. The interface 43 is connected to the PC 100 via the communication cable 400, and is a communication means for inputting print data from the PC 100 to the printer 1.

The CPU 20 is a computation device, and will control the jetting of the ink drops, the quantity of ink remaining inside the cartridges, or the detection of the presence or absence of ink, in accordance with a control program that is pre-stored in the ROM 21. In addition, jetting timing signals and set signals will be produced, and each of these signals will be moved to the gate array 24 described below.

An LF motor driver 30 that controls the operation of the LF motor 29 that carries the printing sheets and rotates the rotator 40, a feed motor drive circuit 35 that serves to operate the feed motor 34 that rotates the feed rollers 6*a*, 6*b* in order to feed printing sheets to the feed position P1 of the endless belt 8, an electromagnetic drive circuit 36 that serves to operate the electromagnetic valve 53, and a solenoid drive circuit 42 that drives solenoids 42-1, 42-2, and 42-3 that transfer the stopper members 44*e* that restrict the orbital rotation of the planet gears 44*b*1-44*b*3, are connected to the CPU 20, and the operation of each device is controlled by the CPU 20. Furthermore, an operation panel 28 that serves to perform a user's print commands, the paper sensor 31, the position detection sensor 37 of the rotator 40, and the liquid quantity sensor 54, are connected to the CPU 20, and each unit will be controlled based upon the input signals from the operation panel 28 and each sensor 31, 37, 54.

Figure 8:
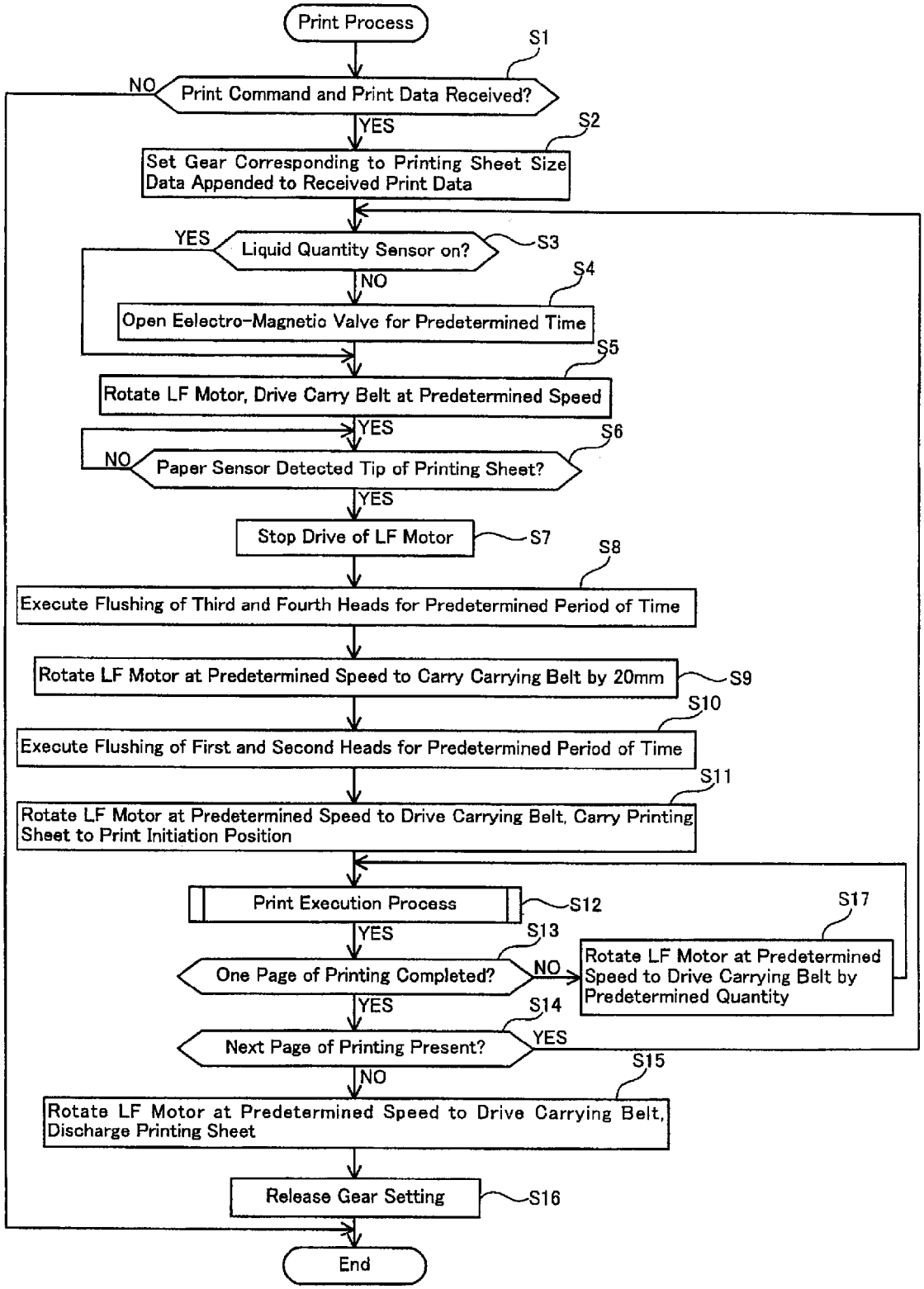
FIG. 8 is a flowchart of a print process that is executed by the CPU of a printer.
Figure 9:
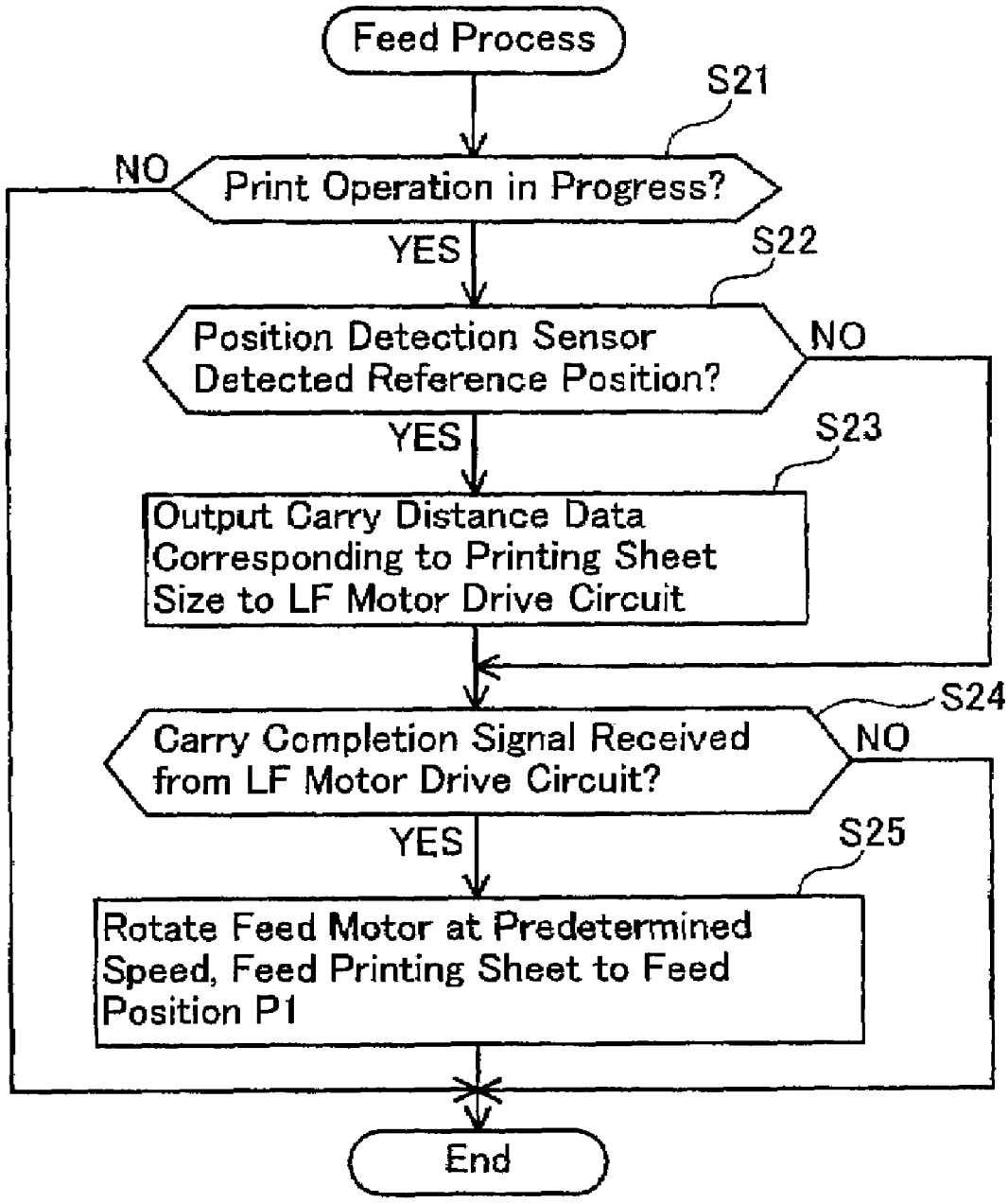
FIG. 9 is a flowchart of a feed process that is executed by the CPU of a printer.

The ROM 21 is a non-volatile memory that cannot be overwritten, and each control program that is executed by the CPU 20, and in addition, fixed value data, are stored therein. The program of the flowchart shown in FIGS. 8 and 9 are stored in the ROM 21 as a portion of the control program. In addition, carry distance data is stored in the ROM 21 as fixed value data.

Figure 6:
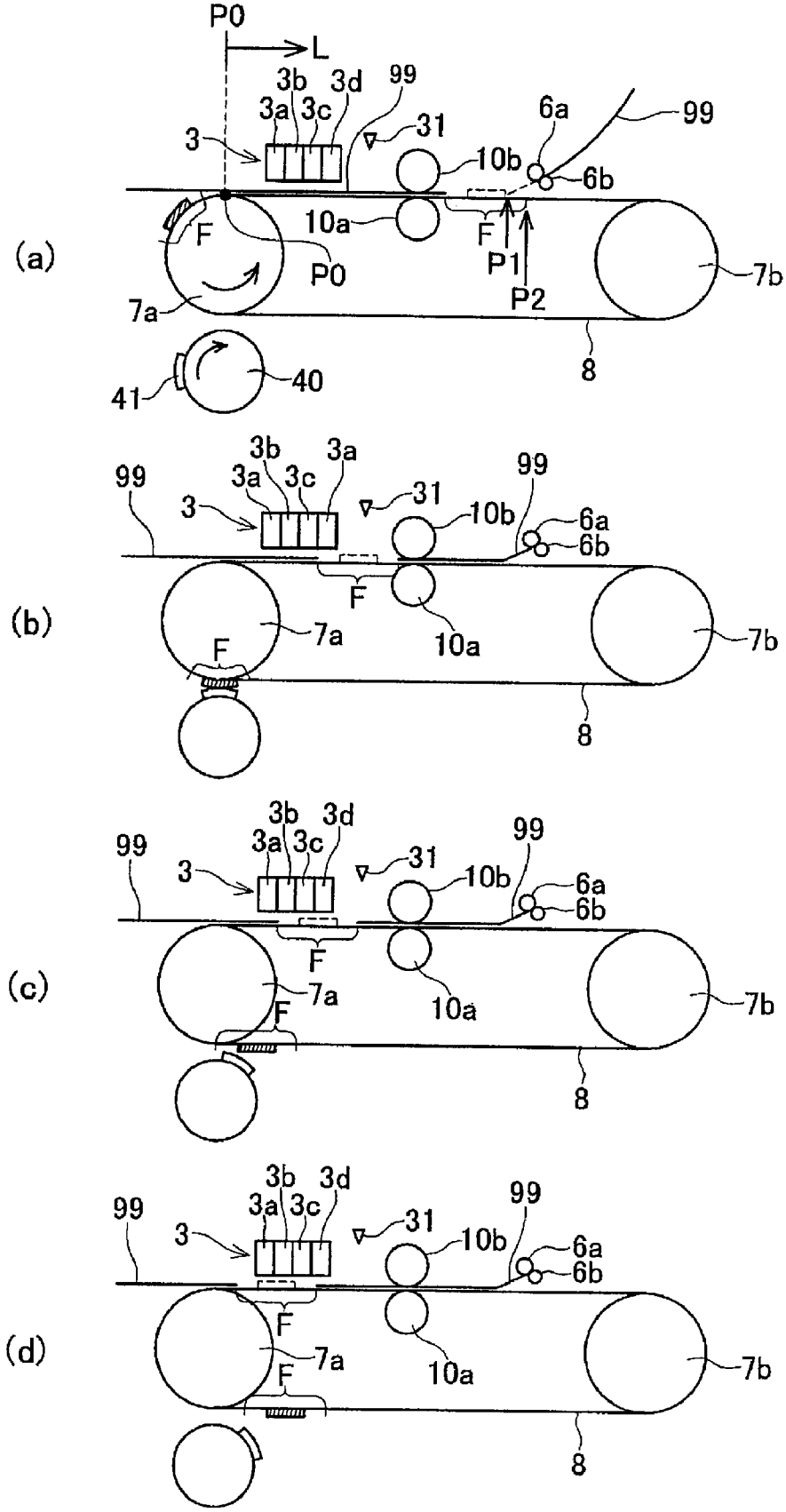
FIG. 6 (*a*)-(*d*) shows in time series the carry states of A6 size printing sheets during a printing operation.

The carry distance data is data that indicates the end position P2 of the flushing region at the time at which the reference position of the rotator 40 is detected by the position detection sensor 37 (the time shown in FIG. 6(*a*)). In the present embodiment, the end position P2 is indicated by the distance measured from the feed position P1 toward the upstream side. Actually, because the tip of a printing sheet will arrive at the feed position P1 when the printing sheet is fed 10 mm by the feed roller 6*a*, the carry distance data is the value obtained by subtracting 10 mm from the distance measured from the feed position P1 toward the upstream side to the end position P2 of the flushing region. If a printing sheet will arrive at the feed position P1 at the same time as the feed roller 6*a* starts rotating, the carry distance data may simply be the distance measured from the feed position P1 toward the upstream side to the end position P2.

The carry states of the printing sheets during a print operation of the printer 1 will be explained by employing FIGS. 6 and 7. FIG. 6 shows, in time series, the carry states of A6 size printing sheets during a print operation and flushing operation. FIG. 6(*a*) shows the position of printing sheet 99, and the position of a flushing region F on the endless belt 8, at the time in which the reference position of the rotator 40 was detected by the position detection sensor 37. The time at which the reference position of the rotator 40 is detected by the position detection sensor 37 is the time at which the reference position of the rotator 40 will be directly overhead if the rotator 40 is further rotated 90 degrees in the clockwise direction. FIG.

6(*b*) shows the state in which the rotator 40 is rotated 90 degrees in the clockwise direction from the state shown in FIG. 6(*a*). In other words, FIG. 6(*b*) shows the time at which the center of the sponge member 41 has arrived at an imaginary line connecting the center of the rotator 40 and the center of the belt roller 7*a*. The endless belt 8 is carried only 190/4 mm between FIG. 6(*a*) and FIG. 6(*b*). As noted above, when printing on an A6 size printing sheet with the printer 1, the printer 1 will be adjusted to a relationship in which the endless belt 8 is transported 190 mm during one rotation of the rotation 40.

FIG. 6(*c*) shows the position of the printing sheets 99 and the flushing region F on the endless belt 8 at the time when the tip of a printing sheet is detected by the paper sensor 31. FIG. 6(*d*) shows the position of the printing sheets 99 and the flushing region F on the endless belt 8 at the time when the flushing process has been completed by the first to fourth heads 3*a*-3*b*.

Figure 7:
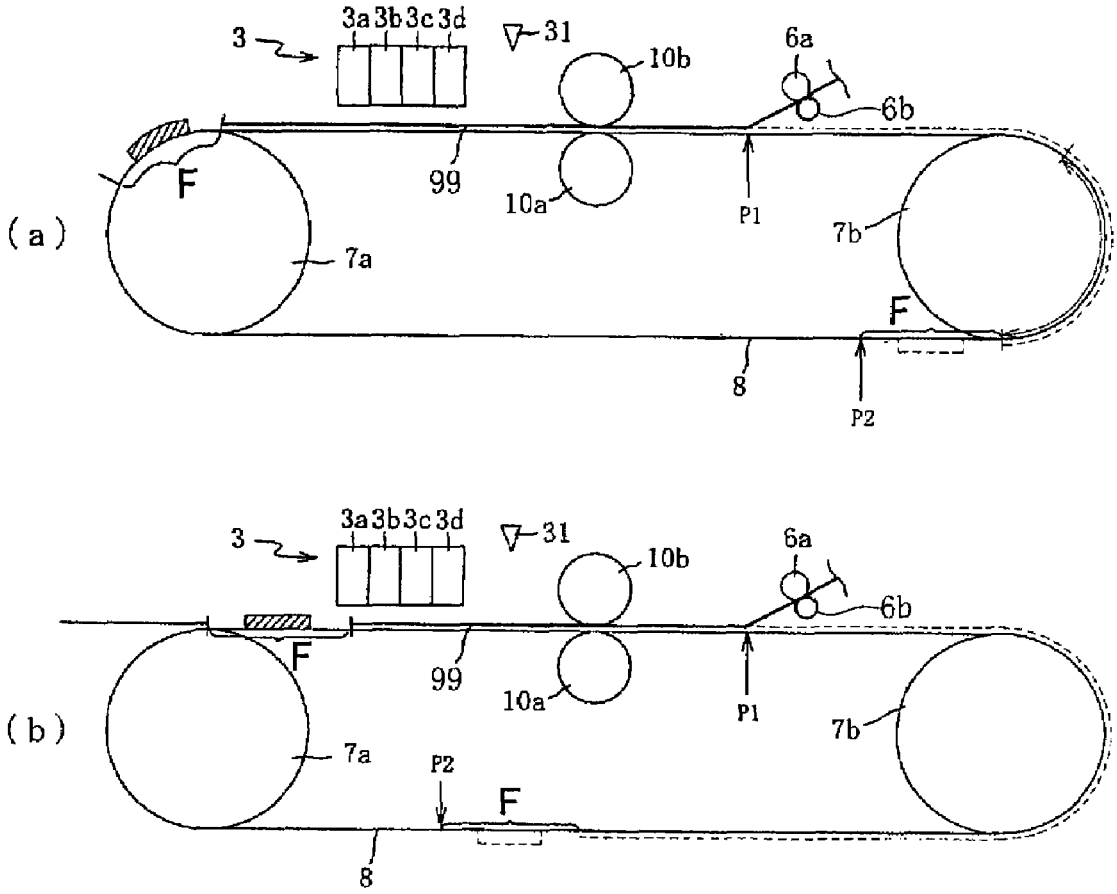
FIG. 7 shows the positions of a printing sheet and the flushing regions on an endless belt at the times in which the reference position of the rotator is detected by the position detection sensor, with FIG. 7(*a*) showing an A4 size printing sheet, and FIG. 7(*b*) showing an A3 size printing sheet.

In addition, FIG. 7 shows the positions of a printing sheet 99 and the flushing regions F on the endless belt 8 at the time when the reference position of the rotator 40 is detected by the position detection sensor 37, with FIG. 7(*a*) showing an A4 size printing sheet 99, and FIG. 7(*b*) showing an A3 size printing sheet 99.

The carry distance data stored in ROM 21 of the printer 1 includes the carry distance data corresponding to each respective size of printing sheet (A6, A4, A3). Here, a detailed explanation of the carry distance data will be provided with reference to FIG. 5. FIG. 5 is a table showing the position of the end P2 of the flushing region F (the flushing region F that will pass by the inkjet head 3 next), at the time when the reference position of the rotator 40 is detected by the position detection sensor 37. In other words, FIG. 5 shows the position of the end P2 of the flushing region F at the timing shown in FIG. 6(*a*), FIG. 7(*a*), and FIG. 7(*b*).

As shown in FIG. 5, when an A6 size printing sheet that is 150 mm in length is printed, the end position P2 of the flushing region F is located 157.5 mm upstream from the origin P0. As noted above, the feed position P1 is 142.5 mm upstream from the origin P0. The end position P2 of the flushing region F is 15.0 mm upstream from the feed position P1. The carry distance data stored in ROM 21 is a value in which 10 mm was subtracted from 15.0 mm, and thus 5.0 mm is stored.

As will be described below, the printer 1 uses the position detection sensor 37 to watch for the time at which the rotator 40 reaches the reference position. In other words, the printer 1 will watch for the timing shown in FIG. 6(*a*). When this timing is reached, the printer 1 will start measuring the carry distance of the endless belt 8, and will watch for the arrival of the time at which the measured distance that the endless belt 8 has been carried becomes equal to the carry distance. When an A6 size printing sheet is printed, the printer 1 will watch, from the positional relationship of FIG. 6(*a*), for the arrival of the time at which the endless belt 8 has been carried by 5.0 mm. At this time, if the feed motor 34 begins to rotate and the feed rollers 6*a*, 6*b* begin to rotate, the tip of a printing sheet will arrive at the endless belt 8 after the endless belt 8 has been carried further by an additional 10 mm. In other words, from the positional relationship of FIG. 6(*a*), the tip of the printing sheet will arrive at the endless belt 8 at the time in which the endless belt has been moved 15 mm. This will achieve a relationship in which the tip of the printing sheet will arrive at the endless belt 8, at the time in which the end position P2 of the flushing region F of the endless belt 8 coincides with the feed position P1. In other words, a relationship will be insured in which the tip of the printing sheet will be fed to the end position P2 of the flushing region F of the endless belt 8.

Likewise, when the printer 1 prints an A4 size printing sheet, a position 158.75 mm upstream from the feed position P1 will be the end position P2 of the flushing region F at the timing of FIG. 7(*a*). If the feed motor 34 begins to rotate and the feed rollers 6*a*, 6*b* begin to rotate at the time at which the endless belt 8 has been carried 148.75 mm from the positional relationship of FIG. 7(*a*), the tip of the printing sheet will arrive at the endless belt 8 at the time that the endless belt 8 has been moved 158.75 mm from the positional relationship of FIG. 7(*a*). Therefore, the tip of an A4 size printing sheet will arrive at the endless belt 8 at the time in which the end position P2 of the flushing region F of the endless belt 8 coincides with the feed position P1. The tip of an A4 size printing sheet will be fed to the end position P2 of the flushing region F of the endless belt 8.

Likewise, when the printer 1 prints an A3 size printing sheet, a position 428.50 mm upstream from the feed position P1 will be the end position P2 of the flushing region F at the timing of FIG. 7(*b*). If the feed motor 34 begins to rotate and the feed rollers 6*a*, 6*b* begin to rotate at the time at which the endless belt 8 has been carried 418.50 mm from the positional relationship of FIG. 7(*b*), the tip of the printing sheet will arrive at the endless belt 8 at the time that the endless belt 8 has been moved 428.50 mm from the positional relationship of FIG. 7(*b*). Therefore, the tip of an A3 size printing sheet will arrive at the endless belt 8 at the time in which the end position P2 of the flushing region F of the endless belt 8 coincides with the feed position P1. The tip of an A3 size printing sheet will be fed to the end position P2 of the flushing region F of the endless belt 8.

The explanation will now return to FIG. 4. RAM 22 is a volatile memory that can be overwritten, and will temporarily store various data used to execute the control program stored in the ROM 21. The EEPROM 23 is a non-volatile memory that can be overwritten, and a variety of data input from the operation panel 28 by a user will be stored therein. The CPU 20 will read out data from the EEPROM 23 in accordance with need, and will control the print operation based upon data set by a user.

The LF motor driver 30 is a device that operates the LF motor 29 that is constructed of a stepping motor and controls the operation thereof, and comprises an LF motor drive circuit 30*a* for operating the LF motor 29, and a controller 30*b* that controls the drive of the LF motor 29.

The LF motor drive circuit 30*a*, based upon pulse signals input from the controller, will generate various magnetization modes, will perform power amplification to generate power pulses, and will drive the LF motor 29.

The controller 30*b* will output the pulse signals that control the drive quantity of the LF motor 29 to the LF motor drive circuit 30*a* based upon commands from the CPU 20, and is comprised of a carry distance counter 30*b*1, and a signal output unit 30*b*2. The carry distance counter 30*b* is a counter that counts the carry distance of the endless belt 8 that is carried by the LF motor 29. When the controller 20 receives the carry distance data transmitted from the CPU 20, the number of pulses that correspond to the carry distance data received will be set as an initial value in the carry distance counter 30*b*. With carrying performed with a stepper motor, the carry distance that is carried with one pulse will already be known, and thus the received carry distance data will be converted to the number of corresponding pulses, and will be written to the carry distance counter 30*b*. The value set in the carry distance counter 30*b* will be reduced by one for each pulse signal output from the controller 30*b* to the LF motor drive circuit 30*a*.

The signal output unit 30*b* serves to produce carry completion signal. The signal output unit 30*b* is constructed so that a carry completion signal will be output to the CPU 20 when the value counted by the carry distance counter 30*b* becomes zero due to subtraction. When the carry completion signal is input in the CPU 20, it is known that the endless belt 8 has been carried by the distance specified by the carry distance data. In this way, the CPU 20 will determine the feed timing of the printing sheet, and the CPU 20 will order the motor drive circuit 35 to feed the printing sheet.

According to the present embodiment, consecutive printing sheets are carried on the endless belt 8 having a predetermined gap therebetween, and the timing at which the gap between the consecutive printing sheets is positioned directly below the carry roller 7*a* can be matched with the timing at which the reference position of the rotator 40 points directly upward. In other words, the sponge member 41 can be contacted with the endless belt 8 that is exposed in the gap between the consecutive printing sheets, and cleaning liquid can be dispensed thereon.

In addition, because the feed timing of printing sheet is controlled in accordance with the distance that the endless belt 8 is carried, the sponge member 41 can be contacted with the endless belt 8 that is exposed in the gap between the printing sheets, and cleaning liquid can be dispensed thereon, even if the carry speed of the endless belt 8 is changed Note that when the printer 1 is constructed so that the endless belt 8 is carried at a constant speed (such as during continuous printing in which paper feeding is not stopped during recording), a clock or the like arranged in the printer 1 may be used to calculate the carry distance from the carry time, and determine the paper feed timing therefrom.

Next, various control processes that are executed in the printer 1 that is constructed as described above will be described with reference to the flowcharts in FIGS. 8 and 9. FIG. 8 is a flowchart of a print process that is executed by the CPU 20 of the printer 1. This print process is read out from the ROM 21 at predetermined times and executed. Printing and flushing are sequentially executed in the print process. First the process will confirm whether or not a print command and print data have been received (S1), and if a print command and print data have not been received (S1: No), the print process will end because this is not a time to execute printing. On the other hand, if the CPU 20 has received the print command and print data (S1: Yes), the process will determine that there is a print request from the PC 100, and will set the gear (one of the spur gears 45*a*1-45*a*3) corresponding to the printing sheet size data appended to the received print data (S2). More specifically, one of solenoids 42 will be driven by the CPU 20 to remove one of the corresponding stopper members 44*e*.

The print data will be transmitted from the PC 100 connected to the printer 1. Commands that order the printer 1 to print, and other various data needed during print execution (printing sheet size data indicating the size of the printing sheet, font, data indicating the format such as blank spaces, etc.) are appended to the transmitted print data. The printer 1 will determine the size of the printing sheet ordered by the PC 100, and will drive a solenoid to remove a stopper member 44*e* of the planet gears 44*b*1-44*b*3, based upon the printing paper size data appended to the print data In this way, one spur gear 45*a* will be selected by the planet gear 44*b* corresponding to the printing sheet size data.

Next, the process will confirm whether or not the liquid quantity sensor 54 is on (S3), and if the liquid quantity sensor is on (S3: Yes), the process will skip process of S4 in which sufficient cleaning liquid is stored in the sub-tank 50, and will then proceed to the process of S5. On the other hand, if the liquid quantity sensor 54 is off (S3: No), the process will determine that the cleaning liquid of sub-tank 50 is insufficient, will execute an electromagnetic valve control operation and open the electro-magnetic valve 53 for a predetermined period of time (S4), and will dispense a predetermined quantity of cleaning liquid to the sub-tank 50. Then, the process will rotate (drive) the LF motor 29, and will drive the endless belt 8 at a predetermined speed (S5). By driving the LF motor 29 that drives the endless belt 8, the rotator 40 will also be driven. The period in which the rotator 40 will rotate will be restricted by the gear set in the process of S2 in accordance with the printing sheet size. If the printing sheet size is A6, the rotator 40 will rotate once while the endless belt 8 is moved 190 mm, if the printing sheet size is A4, the rotator 40 will rotate once while the endless belt 8 is moved 337 mm, and if the printing sheet size is A3, the rotator 40 will rotate once while the endless belt 8 is moved 460 mm.

Next, the process will confirm whether or not the paper sensor 31 has detected the tip of a printing sheet (S6), and if it has not detected this (S6: No), the process of S7 and thereafter will wait until the tip of a printing sheet is detected. On the other hand, if the tip of a printing sheet is detected (S6: Yes), the process will stop the drive of the LF motor 29 (S7), and will execute a flushing process for a predetermined period of time by means of the third and fourth heads 3*c*, 3*d* (S8). In the present embodiment, a relationship is set in which the paper sensor 31 will detect a printing sheet when the tip of the printing sheet has arrived at a position separated by 10 mm upstream from the rear end (the end on the upstream side of the printing sheet carry path) of the fourth head. When the tip of a printing sheet is detected by the paper sensor 31 (refer to FIG. 6(*c*) or FIG. 10(1), the surface of the endless belt 8 in an area that is 40 mm further downstream therefrom is the flushing region. The CPU 20 can execute flushing in the region of a predetermined gap of the endless belt 8, by executing the flushing process at point in which the tip of a printing sheet is detected by the paper sensor 31 (see FIG. 10(2)). The gap between two flushing regions is predetermined for each size of printing sheet.

Figure 10:
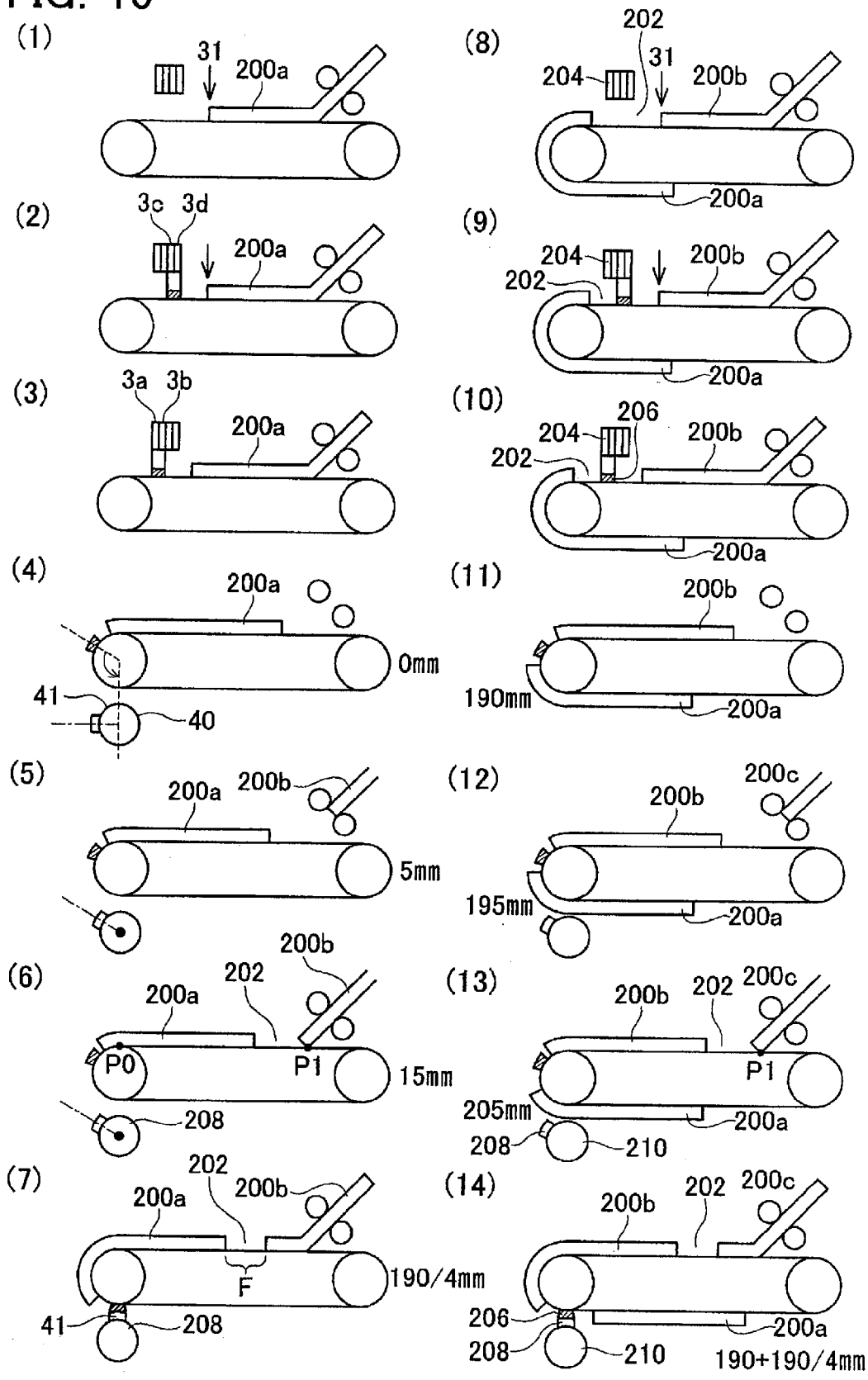
FIG. 10(1)-(14) shows in time series the carry states of a printing sheet during a printing operation and a flushing operation.

Next, the LF motor 29 will be rotated at a predetermined speed to carry the endless belt by 20 mm (S9) (refer to FIG. 10(3)). Then, the flushing will be executed for a predetermined period of time by the first and second heads 3*a*, 3*b* (S10) (refer to FIG. 10(3)). In the present embodiment, the length in the carry direction of the first to fourth heads 3*a*-3*d* is approximately 10 mm, respectively. Thus, by carrying the endless belt 8 by 20 mm, a relationship will be obtained (refer to FIGS. 6(*c*) and (*d*) and FIGS. 10(2) and (3)) in which the portions of the endless belt 8 that will be flushing processed by the third and fourth heads 3*c*, 3*d* will face the first and second heads 3*a*, 3*b*. Thus, ink jetted in the flushing process will adhere to an approximately 20 mm area in the center of the flushing region that is maintained at 40 mm on the endless belt 8. Because a 10 mm gap is maintained between adjacent printing sheets, ink jetted in the flushing process will not adhere to the printing sheet.

Note that when the aforementioned flushing operation is performed rapidly, the flushing may be performed while the endless belt 8 is carried, without stopping the drive of the LF motor 29.

Then, the LF motor 29 will be rotated at a predetermined speed to drive the endless belt 8, and the printing sheet will be carried to the printing initiation position (S11). As shown in FIG. 6(*d*), when the flushing in the process of S10 is completed, the tip of the following printing sheet will be provided in a position that faces the front end of the fourth head 3*d* (the end on the downstream side of the printing sheet carry path). The carry distance data for achieving this relationship has been stored Blank space data is appended to the print data, and thus printing will be begun from a position that is moved back from the tip of the printing sheet toward the rear end side thereof that is equal to the blank space portion. Moreover, ink will begin to be jetted from the inkjet heads 3*a*-3*d* at the time in which the position at which the flushing was performed in the process of S10 is carried by a distance equal to the blank space downstream in the carry direction. Note that when edgeless printing is ordered by the print data, in which printing is performed up to the edges of a printing sheet, there are no blank spaces, and thus a process will not be executed in which the jetting of the ink is begun after the printing sheet is carried downstream in the carry direction.

Next, each head 3*a*-3*d* will be operated in accordance with the position of the printing sheet and the print data, and a print execution process will be performed which jets ink toward the printing sheet (S12). Then, the process will confirm whether or not one page of printing has been completed (S13), and if one page of printing has been completed (S13: Yes), the process will confirm whether or not there is a next page of printing (S14), and if there is no next page of printing (S14: No), then the printing of all of the print data has been completed, and thus the LF motor 29 will be driven at a predetermined speed to drive the endless belt 8, and after the printing sheet is discharged, the gear setting will be released, and the printing process will be complete. On the other hand, if the results confirmed in the process of S113 indicate that one page of printing has not been completed (S13: No), the LF motor 29 will rotate at a predetermined speed to carry the endless belt 8 by a predetermined quantity (S17). Here, the printing sheet will be carried for only the printed portion of the printing sheet (one printing width, i.e., one band portion). Then, the process will proceed to the print execution process of S12. In this way, the jetting of the ink and the carrying of the printing sheet will be sequentially repeated until the printing of one page of print data is complete. In this embodiment, intermittent carrying and ink jetting are sequentially repeated. However, printing may be executed with a continuous carry method in which ink is jetted while the printing sheet is carried.

In addition, if the results confirmed in the process of S14 indicate that there is a next page of printing (S14: Yes), the process will proceed to the process of S3, and will repeat the processes of S3 to S14 until the printing of all print data (all pages) received is completed.

Note that a construction is also possible in which, when it is determined that the printing of all pages has been completed, the operation of the ink jet printer will be completed after the endless belt 8 is circulated. According to this, the portion that was flushed will definitely pass by the position at which the cleaning liquid is dispensed and the blade 48, and thus the ink jetted onto the endless belt 8 will not be left on the endless belt.

FIG. 9 is a flowchart of the feed process that is executed at a predetermined time by a timer interrupt process in the printer 1. The feed process is a process that feeds a printing sheet to the feed position P1, and will first confirm whether or not a print operation is underway (S21), and if a print operation is not underway (S21: No), the feed process will end because there no need to perform feeding. On the other hand, if a print operation is underway (S21: Yes), the position detection sensor 37 will confirm whether or not the reference position of the rotator 40 has been detected (S22). The CPU 20 will confirm the signal input state from the position detection sensor 37 in the process of S22, and if detection signals have been input, the reference position of the rotator 40 has been detected, in other words, the reference position of the rotator 40 will be detected at the time that it is in a position that is rotated clockwise 90 degrees from directly overhead. When the rotator 40 is rotated 90 degrees in the clockwise direction from this timing, the sponge member 41 will be directly overhead.

When an A6 size printing sheet is printed, as shown in FIG. 6(*a*), the next flushing region will be immediately upstream of the pressing members 10*a*, 10*b* at the timing of S22, the end position P2 will be a distance of 157.5 mm from the origin P0, and in a position 15 mm upstream of the feed position P1. If A4 size, the end position P2 of the next flushing region will be a distance of 301.25 mm from the origin P0, and in a position 158.75 mm upstream of the feed position P1 (refer to FIG. 5 and FIG. 7(*a*)). If A3 size, the end position P2 of the next flushing region will be a distance of 570 mm from the origin P0, and in a position 428.5 mm upstream of the feed position P1 (refer to FIG. 5 and FIG. 7(*b*)).

When it is determined in the process of S22 that the position detection sensor 37 has detected the reference position of the rotator 40 (S22: Yes), the carry distance data corresponding to the printing sheet to be carried will be read out from the ROM 21, and the carry distance data corresponding to the size of that printing sheet will be output to the LF motor driver 30 so that the tip of the printing sheet is fed to the end position P2 of the next flushing region F. In this way, the carry distance corresponding to the carry distance data will be measured with the LF motor driver 30, and carry completion signals will be output at the time that the carry distance of the endless belt corresponding to the carry distance data is completed.

After the output of the carry distance data, the process will confirm whether or not the carry completion signal has been received from the LF motor driver 30 (S24), and if the carry completion signal has been received (S24: Yes), it will be understood that the carry distance of the endless belt 8 corresponding to the carry distance data has been completed, and it is determined that this is the time to initiate feeding of the printing sheet. Then the feed motor 34 starts rotation at a predetermined speed (a speed at which the carry speed of the endless belt 8 by the LF motor 29 equals the speed at which the printing sheet is fed), the printing sheet will be fed to the feed position P1 (S25), and the feed process will be completed.

On the other hand, when the position detection sensor 37 has not detected the reference position of the rotator 40 in the process of S22 (S22: No), it will not be time to set the carry distance data in the carry distance counter 30*b*1 of the LF motor driver 30, and thus the process of S23 will be skipped, and the process will proceed to the process of S24.

In addition, if the results confirmed in the process of S24 indicate that the carry completion signal was not received from the LF motor driver 30 S24: No), the feed process will not be initiated These states are shown in frame format from FIGS. 10(5) to (7), and a gap 202 that will be a flushing region F will be maintained between the initial printing sheet 200*a* and the next printing sheet 200*b*.

Thus, in the feed process of FIG. 9, the feed timing of the printing sheet will be controlled based upon the rotation position of the rotator 40, and then the carry distance of the endless belt 8. In this way, the printing sheets can be fed so that the tip of a printing sheet will be provided at each prescribed gap determined in advance on the endless belt 8.

FIG. 10 illustrates sequence of movement in a case of printing on A6 size paper. FIG. (1) illustrates timing when the tip of sheet 200*a* is detected by paper sensor 31. FIG. (2) illustrates flushing operation by inkjet heads 3*c* and 3*d*. FIG. (3) illustrates flushing operation by inkjet heads 3*a* and 3*b*. FIG. (4) illustrates timing when reference timing is detected by position detector sensor 37. That is the cleaning liquid dispenser (rotator 40 and the sponge member 41) has rotated 270 degree clockwise from an angle that the sponge member 41 was located at the highest position (this angle is illustrated in FIG. (7)). In the following, the carry distance of the endless belt 8 is measured from this position. The carry distance of the endless belt 8 at timing (4) is 0 mm. FIG. (5) illustrates timing when the carry distance of the endless belt 8 is 5 mm that is stored in the carry distance data storage means for A6 size paper. At this timing, paper feed operation of next sheet 200*b* is initiated. FIG. (6) illustrates timing when the carry distance of the endless belt 8 is 15 mm. At this timing, newly fed paper 200*b* contacts the endless belt 8 at feed position P1. The feed initiation timing as shown in FIG. (5) and the carry distance data stored in the carry distance data storage means is selected so that gap 202 of 40 mm width is formed between printing papers 200*a* and 200*b*. FIG. (7) illustrates timing when the carry distance of the endless belt 8 is 190/4 mm. At this timing, the sponge member 41 is located at the highest position and contacts the endless belt 8. The cleaning liquid is supplied to the endless belt at a position contacting with the sponge member 41. The feed initiation timing as shown in FIG. (5) is selected so that the sponge member 41 contacts the ink adhered to the endless belt 8 at gap 202 during the steps (2) and (3).

FIG. (8) illustrates timing when the tip of sheet 200*b* is detected by paper sensor 31. FIG. (9) illustrates flushing operation by inkjet heads 3*c* and 3*d*. The ink jetted for flushing operation adheres on the top surface of the endless belt 8 at gap 202. FIG. (10) illustrates flushing operation by inkjet heads 3*a* and 3*b*. The ink jetted for flushing operation adheres on the same position at gap 202. FIG. (11) illustrates timing when reference timing is detected by position detector sensor 37. The carry distance of the endless belt 8 is 190 mm from timing at (4). The situations at timing (4) and (11) are completely same except that paper 200*a* is changed to paper 200*b*. FIG. (12) illustrates timing when the carry distance of the endless belt 8 is 190+5 mm. At this timing, paper feed operation of next sheet 200*c* is initiated. FIG. (13) illustrates timing when the carry distance of the endless belt 8 is 190+15 mm. At this timing, fed paper 200*c* contacts the endless belt 8 at feed position P1. The feed initiation timing as shown in FIG. (12) is set so that gap 202 of 40 mm width is formed between paper 200*b* and 200*c*. FIG. (14) illustrates timing when the carry distance of the endless belt 8 is 190+190/4 mm. At this timing, the sponge member 41 is located at the highest position and contacts the endless belt 8 at gap 202 between printing papers 200*a* and 200*b*. The cleaning liquid is supplied to the endless belt at a position contacting with the sponge member 41. The feed initiation timing as shown in FIG. (12) is selected so that the sponge member 41 contacts the ink adhered to the endless belt 8 at gap 202 during the steps (9) and (10).

As described, the feed initiation timing illustrated in FIGS. (5) and (12) is selected so that gap 202 of 40 mm width is formed between consecutive papers 200*a* and 200*b* as shown in FIG. (6), or 200*b* and 200*c* as shown in FIG. (13). The feed initiation timing illustrated in FIGS. (5) and (12) is also selected so that gap 202 contacts the sponge member 41 when the sponge member 41 is located at the highest position as shown in FIGS. (7) and (14).

In a case of printing on A4 size paper, the rotation ratio of rotator 40 and endless belt 8 is changed so that the situation (7) is obtained at the carry distance of 337/4 mm, and the situation (14) is obtained at the carry distance of 337+337/4 mm. The feed initiation timing illustrated in FIGS. (5) and (12) is selected so that gap 202 of 40 mm width is formed between consecutive papers 200*a* and 200*b* as shown in FIG. (6), or 200*b* and 200*c* as shown in FIG. (13). In this case, papers 200*a* to 200*c* are A4 size.

In a case of printing on A3 size paper, the rotation ratio of rotator 40 and endless belt 8 is changed so that the situation (7) is obtained at the carry distance of 460/4 m×n, and the situation (14) is obtained at the carry distance of 460+460/4 mm. The feed initiation timing illustrated in FIGS. (5) and (12) is selected so that gap 202 of 40 mm width is formed between consecutive papers 200*a* and 200*b* as shown in FIG. (6), or 200*b* and 200*c* as shown in FIG. (13). In this case, papers 200*a* to 200*c* are A3 size.

Feed carry distance data as shown in FIG. 5 and stored in the ROM 21 is selected such that above described sequence can be obtained.

As described above, according to the printer 1 of the present embodiment, the amount of time in which the endless belt 8 transfers a prescribed distance that is determined in advance can be synchronized with the period in which the rotator 40 will rotate one time, and cleaning liquid will be intermittently dispensed on the endless belt 8 by operation of the rotator 40. Because the period of the rotator 40 is synchronized with the carry distance of the endless belt 8, the carry distance of the endless belt 8 can be set from the amount of rotation of the rotator 40. For example, if the reference position of the rotator 40 being directly overhead is used as a reference (the center of the sponge member 41 is provided on an imaginary line that connects the center of the rotator 40 and the center of the belt roller 7*a*), it can be known whether a flushing region is formed on any position of the endless belt 8. Moreover, by controlling the timing of the feed of the feed device in accordance with the rotation position of the rotator 40, a relationship can be maintained in which a printing sheet will be provided at each predetermined gap on the endless belt 8, a flushing region will be formed on the endless belt 8 that is exposed to the outside between the printing sheets, and the sponge member 41 that rotates will contact the flushing regions. Cleaning liquid can be intensively dispensed toward intermittently formed flushing regions during printing.

Next, a second embodiment will be described with reference to FIG. 11 and FIG. 12. In the printer 1 of the aforementioned first embodiment, the timing of the reference position of the rotator 40 being detected by the position detection sensor 37 is the reference which controls the feed initiation timing of the printing sheets. In the second embodiment, when a plurality of pages are to be continuously printed, the feed initiation timing of only the first page will be controlled based upon the rotation location of the rotator 40, and the feeding of the second page and thereafter will be begun at the point in which the rear end of the initial printing sheet is detected by the paper sensor 31. Note that the components that are identical to the aforementioned first embodiment have the same reference numerals, and a description thereof will be omitted.

Figure 11:
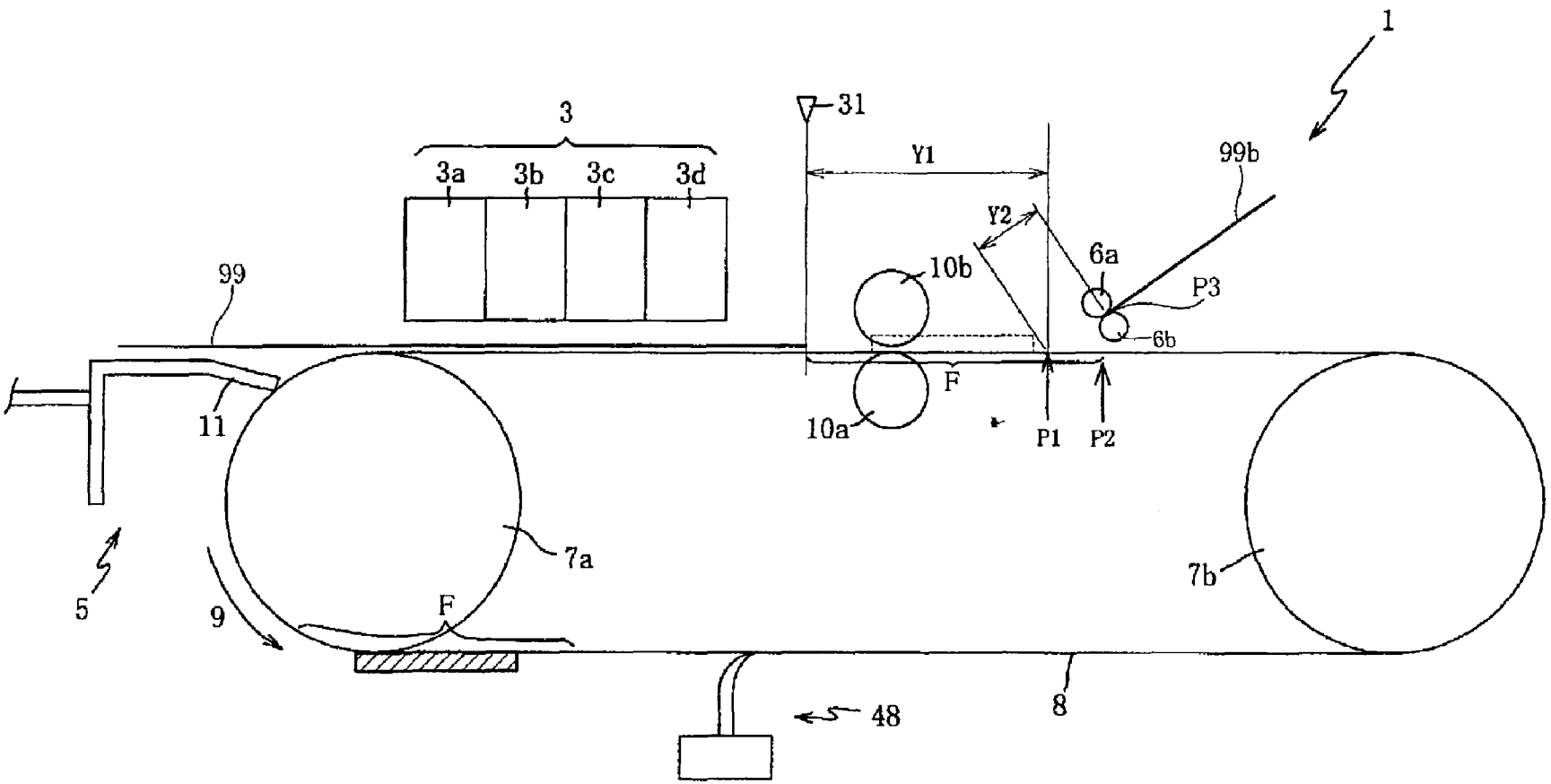
FIG. 11 shows, in a second embodiment, the carry state of an A6 size printing sheet when the rear end of the printing sheet is detected by a paper sensor FIG. 12 (A) and (B) show a flowchart of a print process and a flushing process in the second embodiment.
Figure 12A:
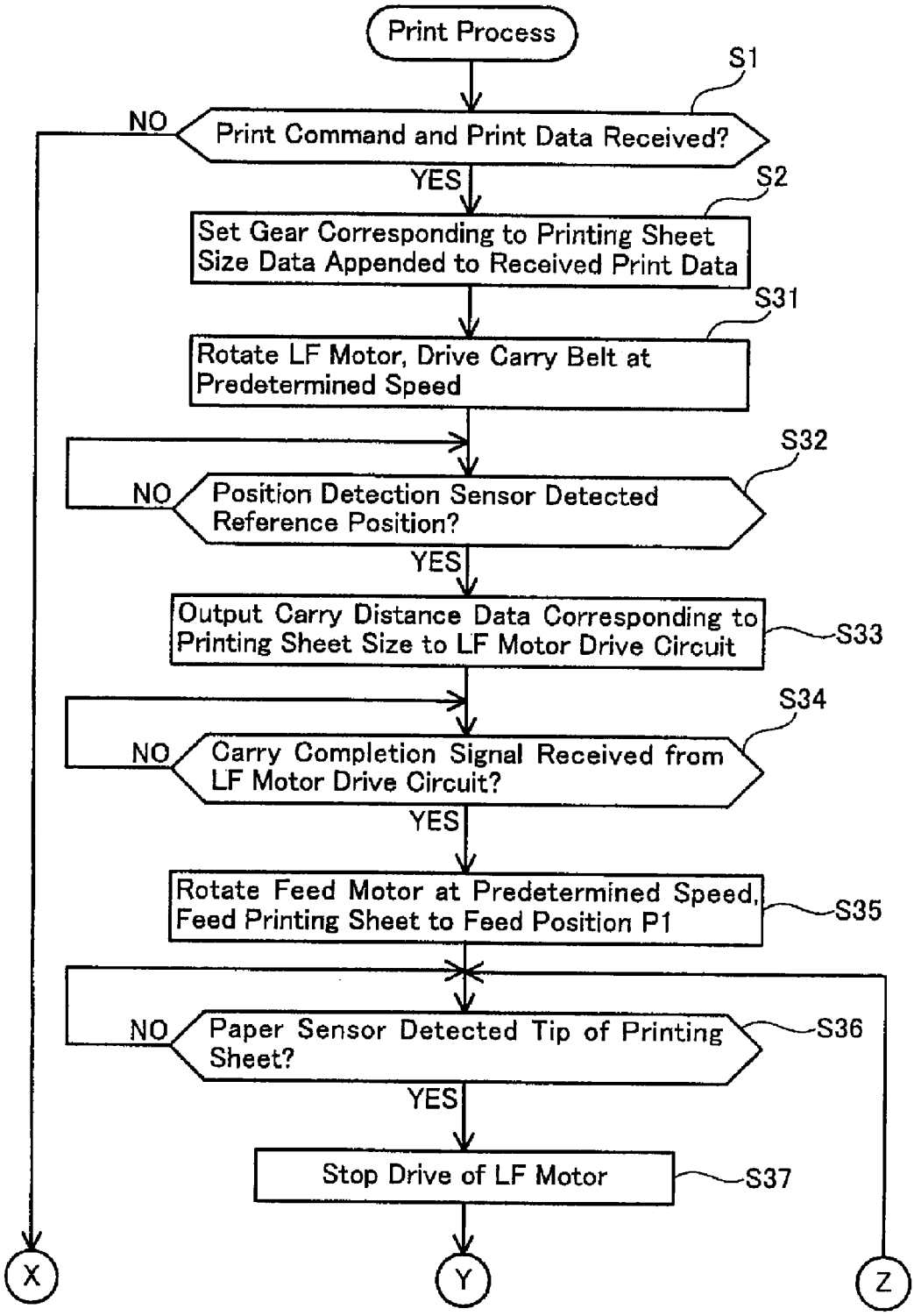
Figure 12B:
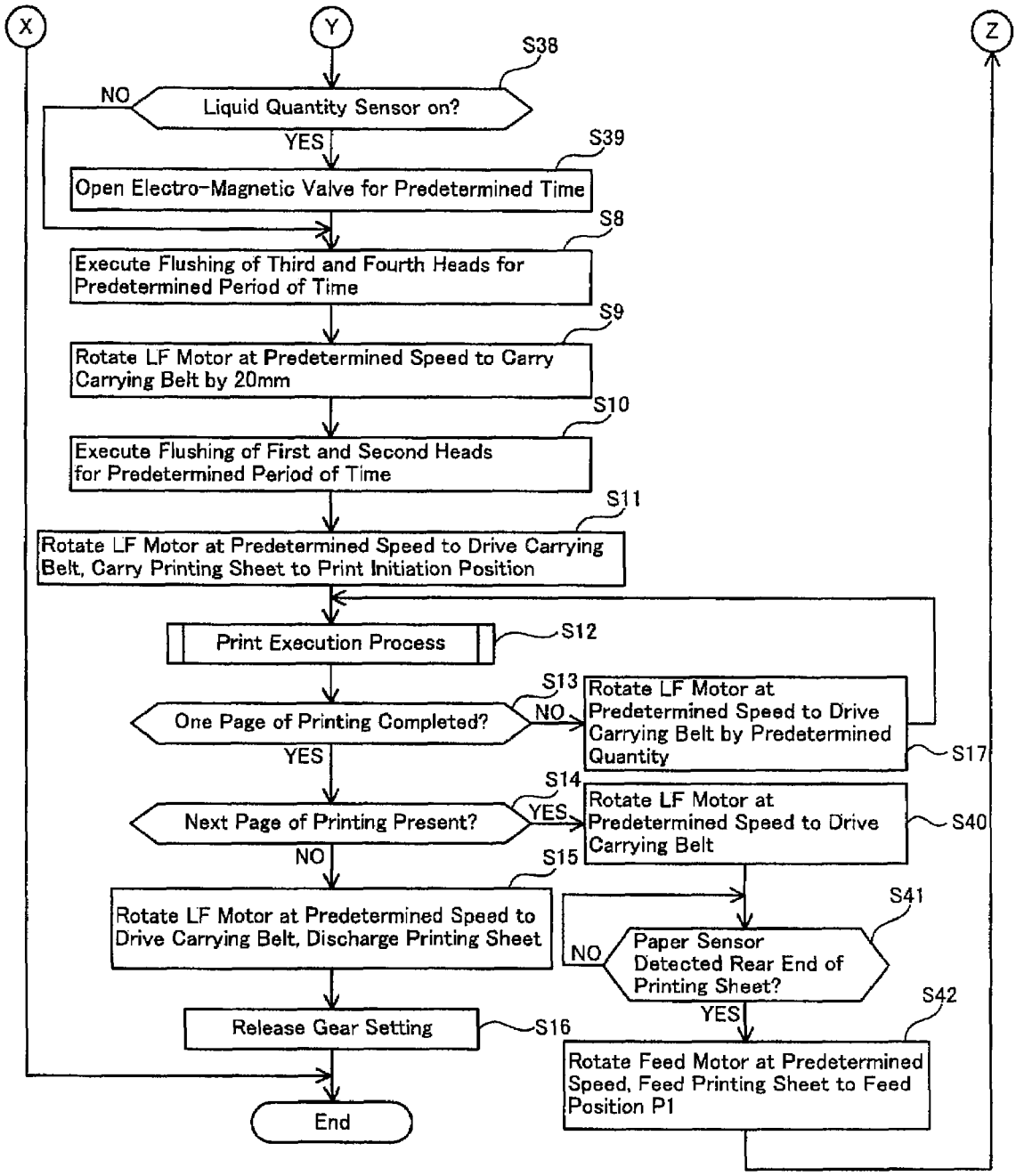

FIG. 11 shows the carry position of an A6 size printing sheet when the rear end of the printing sheet is detected by the paper sensor 31. In FIG. 11, P2 indicates the position of the rear end of the next flushing region F. Note that in FIG. 11, the illustration of the LF motor 29, the rotator 40, the transmission unit 47, the feed tray 4, the paper discharge unit 5, the cleaning liquid dispenser 55, and the like are omitted.

As shown in FIG. 11, the printer 1 of the second embodiment, like the printer 1 of the first embodiment, will carry printing sheet 99 by operation of the endless belt 8 that is driven by the belt rollers 7*a*, 7*b*. In addition, like with the first embodiment, the flushing process is performed on the endless belt 8. Ink jetted onto the endless belt 8 will be removed by means of the blade 48, after cleaning liquid is dispensed by a sponge member attached to the rotator 40 arranged below the belt roller 7*a*.

In the second embodiment, the total of a distance Y1 from the feed position P1 to the detection position of the paper sensor 31, and a feed path length Y2 (the distance from the nip point P3 of the feed rollers 6*a*, 6*b* to the feed position P1) is set so as to be equal to the length of the flushing region F in the carry direction. More specifically, in the second embodiment, the length of the flushing region F in the carry direction is 40 mm, the feed path length Y2 is 10 mm, and the distance Y1 from the feed position P1 to the detection position of the paper sensor 31 is 30 mm. Because the feed motor 34 feeds the printing sheets at the same speed as the speed at which the LF motor 29 carries the printing sheet 99, the timing at which the rear end of the printing sheet is detected by the paper sensor 31 is the timing at which the following printing sheet 99*b* is fed.

Next, the print process in the second embodiment will be explained with reference to FIG. 12. FIG. 12 is a flowchart of the print process in the second embodiment. First, in the print process of the second embodiment, like in the first embodiment, if a print command and print data has been received (S1: Yes), the gear (one of the spur gears 45*a*1-45*a*3) corresponding to the size data of the printing sheet appended to the received print data will be set (S2).

Then, the LF motor 29 will rotate (drive) to drive the endless belt 8 at a predetermined speed (S31), and it will be confirmed whether or not the position detection sensor 37 has detected the reference position of the rotator 40 (S32). If it was not determined that the position detection sensor 37 has detected the reference position of the rotator 40 (S32: No), the reference position of the rotator 40 is not detected, and thus the process will stand by for that detection, and if it is determined that the reference position of the rotator 40 was detected by the position detection sensor 37 (S32: Yes), the carry distance data corresponding to the size of the printing sheet will be output to the LF motor driver 30 (S33). Next, the process will confirm whether or not a carry completion signal has been received from the LF motor drive circuit 30 (S34), and if the carry completion signal has not been received (S34: No), the process will stand by to receive that signal. On the other hand, if a carry completion signal has been received (S34: Yes), it will be determined that the carrying of the endless belt at a distance corresponding to the carry distance data has been completed, i.e., that it is time to begin feeding a next printing sheet, the feed motor 34 will be rotated at a predetermined speed (a speed at which the carry speed of the printing sheets by the LF motor 29 is equal to the speed at which the printing sheet is fed), and a printing sheet will be fed up to the feed position P1 (S35).

Then, the process will determined whether or not the tip of a printing sheet has been detected by the paper sensor 31 (S36), and if the tip of the printing sheet has not been detected (S36: No), the process will stand by for that detection. On the other hand, if the tip of a printing sheet has been detected (S36. Yes), the drive of the LF motor 29 will stop (S37), the process will confirm whether or not the liquid quantity sensor 54 is on (S38). If the liquid quantity sensor 54 is on (S38: Yes), there is sufficient cleaning liquid stored in the sub-tank 50, and thus the process of S39 will be slipped and the process will proceed to the process of S38. On the other hand, if the liquid quantity sensor 54 is on (S38: No), this will indicate that the cleaning liquid in the sub-tank 50 is insufficient. Thus, the open operation and close operation of the electromagnetic valve will be executed in order to open the electromagnetic valve 53 for a predetermined period of time (S39), and a predetermined quantity of cleaning liquid will be dispensed in the sub-tank 50.

Then, as in the first embodiment, the processes of S8-S13, S17 will be executed, and a flushing process and the printing of one page will be performed. When one page of printing is completed (S13: Yes), the process will confirm whether or not there is another page of printing (S14), and if a next page is not to be printed (S14: No), like in the first embodiment, the printing sheet will be discharge, and then the setting of the gear will be eliminated, and the print process will be completed.

On the other hand, if there is a next page to be printed (S14: Yes), a process will rotate the LF motor 29 at a predetermined speed to drive the endless belt 8 (S40), and a process will confirm whether or not the paper sensor 31 has detected the rear end of the printing sheet (S41). If the rear end of a printing sheet is not detected here (S41: No), the process will stand by for the detection of the rear end of the printing sheet, and when the rear end of the printing sheet is detected (S41: Yes), the feed motor 34 will be rotated at a predetermined speed and a printing sheet will be fed to the feed position P1 (S42). Then, that process will proceed to the process of S36.

As explained above in the second embodiment, a printing sheet can be provided on the endless belt 8 at a prescribed gap determined in advance for each printing sheet, and a flushing region can be formed, in the same way as described in the first embodiment, even by executing feeding operation of printing sheet at the point that the rear end of the initial printing sheet is detected by the paper sensor 31.

Next, a third embodiment will be explained with reference to FIG. 13. In the first embodiment, a rotator 40 was formed with a columnar member, in which the distance from the center thereof to the circumferential edge thereof is uniform. Instead of this, in the third embodiment, the rotator will be constructed with a cam that will change the distance from the rotation shaft to the circumferential edge thereof. In addition, in the first embodiment, the cleaning liquid dispenser 55 is constructed so as to use the rotation movement of the rotator 40 in order to intermittently dispense cleaning liquid on the endless belt 8 by means of the sponge member 41 integrally arranged on the rotator 40. Instead of this, the third embodiment is constructed so that the cleaning liquid will be intermittently dispensed on the endless belt 8 by means of a sponge member 41 that moves reciprocally by means of the rotational movement of the cam. Note that the components that are identical to the aforementioned first embodiment have the same reference numerals, and a description thereof will be omitted.

Figure 13:
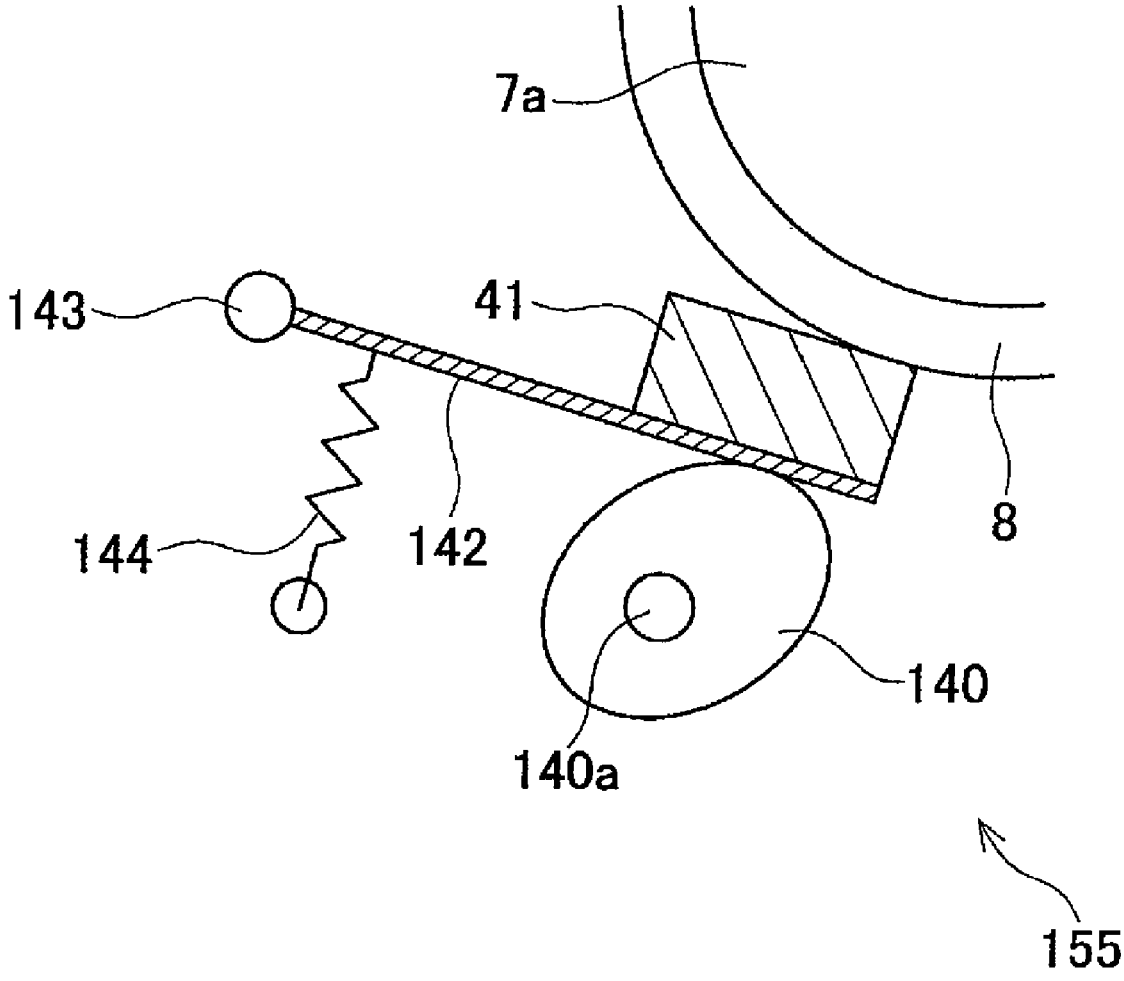
FIG. 13 is a partially enlarged view of a cleaning liquid dispenser of a printer in a third embodiment.

FIG. 13 is a partially enlarged view of a cleaning liquid dispenser 155 according to the third embodiment. In the third embodiment, the rotator is formed with an eccentric cam 140 that changes the distance from the shaft 140*a* that is the rotational center thereof to the circumferential edge thereof. The eccentric cam 140 is formed in a column shape having a length that is at least the same as the width of the endless belt 8, the lengthwise direction thereof is arranged along the width direction of the endless belt 8, and is provided below the belt roller 7*a* and opposite the belt roller 7*a*.

A plate member 142 is arranged between the eccentric cam 140 and the endless belt 8, and is formed to be pivotable in the endless belt direction near the endless belt 8, and to be pivotable in the direction opposite the endless belt away from the endless belt 8. The lengthwise direction of the plate member 142 is equal to the width of the endless belt 8 or longer, and is provided along the width direction of the endless belt 8. In addition, one end of the plate member 142 in the width direction that is perpendicular to the lengthwise direction of the plate member 142 faces the endless belt 8, and a sponge member 41 is attached thereto. The sponge member 41 is provided in a straight line on the plate member 142 along the width of the endless belt 8. A support member 143 is connected to another end of the plate member 142 in the width direction. The support member 143 pivotably supports the other end of the plate member 142 in a predetermined position inside the printer 1. Furthermore, an urging member 144 that urges the plate member 142 in a direction away from the endless belt 8 (the direction opposite the endless belt direction) is attached between one end of the plate member 142 in the width direction and the other end thereof, and the plate member 142 is urged in a direction away from the endless belt 8 by means of the urging force of the urging member 144

A circumferential edge, on the long diameter side of the rotated eccentric cam 140, will be contacted with the rear surface of the plate member 142 (the side on which the sponge member 41 is not formed) (the first state). The plate member 142 will resist the urging force of the urging member 144, and be pushed in the endless belt 8 direction by contact with the eccentric cam 140, and the sponge member 41 will be contacted with the endless belt 8. When the eccentric cam 142 is further rotated, the short diameter side of the eccentric cam 140 will be provided on the plate member 142 side, and the plate member 142 will not be in contact with the eccentric cam 140 (second state). As a result, the pushing state caused by the eccentric cam 140 will be released, and the sponge member 41 will be separated from the endless belt 8 by means of the urging force of the urging member 144. Because of this, the cleaning liquid that the sponge member 41 is saturated with can be intermittently dispensed on the endless belt 8.

Note that although not illustrated in the figures, a tube that dispenses cleaning liquid from the sub-tank 50 is connected to the plate member 142, and cleaning fluid will be dispensed from the sub-tank 50 via the tube.

As described above in the third embodiment, due to the rotational movement of the eccentric cam 140, cleaning liquid can be intermittently dispensed, and dispensed so as to match a flushing region, even by contacting and separating the sponge member 41 arranged on the plate member 142 with respect to the endless belt 8.

Next, a fourth embodiment will be explained with reference to FIG. 14. In the first embodiment, the cleaning liquid dispenser 55 is constructed so as to dispense cleaning liquid on the endless belt by contacting the sponge member 41 on the endless belt 8. Instead of this, the cleaning liquid dispenser of the fourth embodiment is constructed so as to jet cleaning liquid onto the endless belt 8, and dispense cleaning liquid on the endless belt 8 without contact, in accordance with the rotational movement of the rotator 40. Note that the components that are identical to the aforementioned first embodiment have the same reference numerals, and a description thereof will be omitted.

Figure 14:
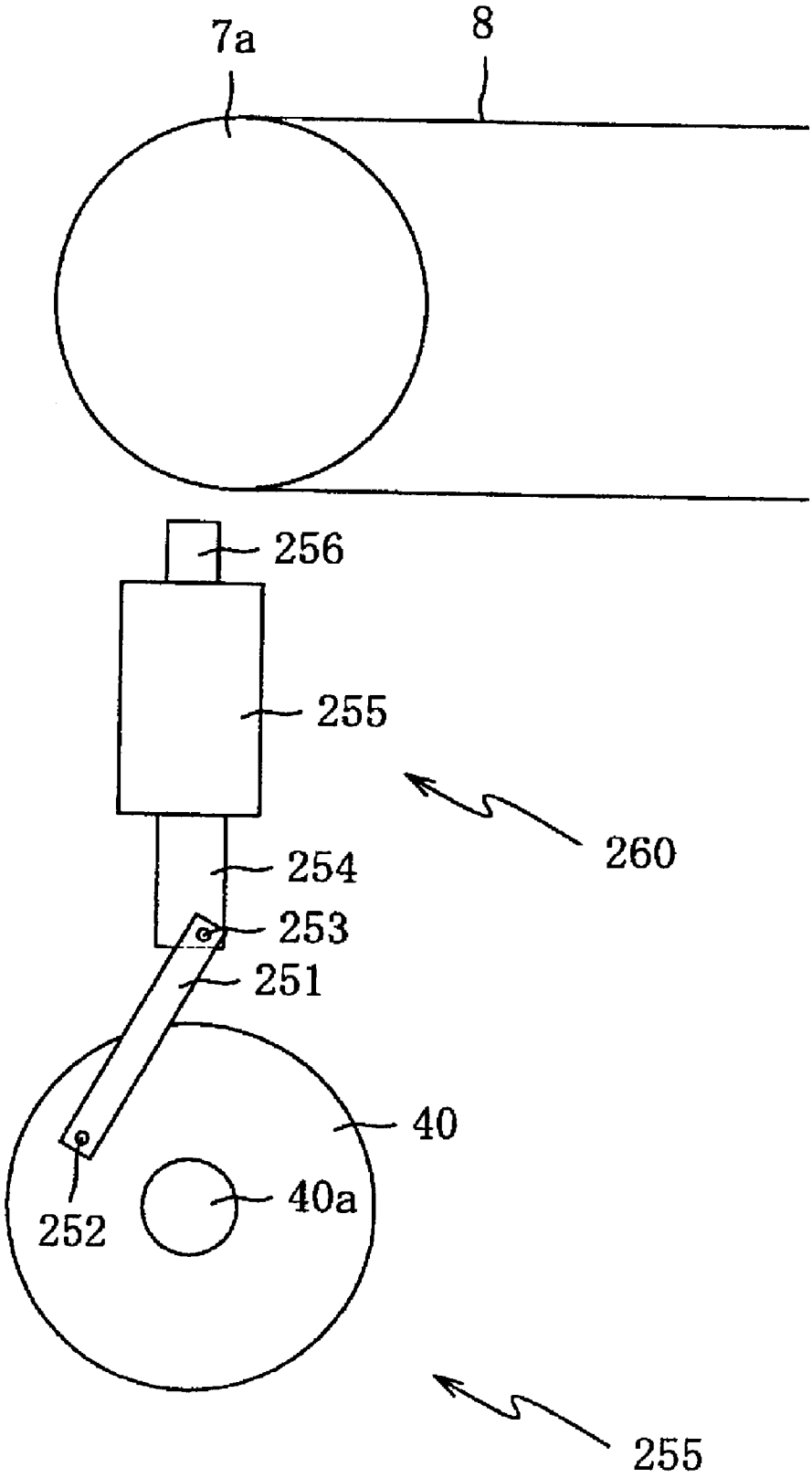
FIG. 14 is a partially enlarged view of a cleaning liquid dispenser of a printer in a fourth embodiment.

FIG. 14 is a partially enlarged view of a cleaning liquid dispenser 255 in the fourth embodiment. The rotator 40 is arranged below the belt roller 7*a*, and the cleaning liquid dispenser 255 comprises a sprayer 255 that jets cleaning liquid onto the endless belt 8 in accordance with the rotational movement of the rotator 40.

The sprayer 260 is arranged between the rotator 40 and the endless belt 8, and comprises a hollow and substantially cylindrical shaped cylinder 255 that stores cleaning liquid. A nozzle (conduction port) that is the dispensing port for the cleaning liquid projects on the tip of the cylinder 255 toward the endless belt 8. A piston 254 that slides on the inner wall of the cylinder 255 is arranged inside the cylinder 255. The piston 254 is formed in a substantially cylindrical shape that extends along the lengthwise direction of the cylinder 255, and is formed to be longer than the cylinder 255. The tip side of the piston 254 (the cylinder 255 side) is covered by an elastic member that is formed with rubber or the like that is ink-proof, and the inner periphery of the cylinder 255 is sealed without gaps by the piston 254. On the other hand, one end of a crank 251 is rotatably supported by means of a first linking member 253 on the rear end side of the piston 254. The other end of the crank 251 is linked to the end surface (disk surface) of the rotator 40 by a second linking member 252, and is rotatably supported thereon.

Because of this, the second linking member 252 will circumferentially move in accordance with the rotation of the rotator 40, and the crank 251 will extend and retract around the first linking member 253 with respect to the piston 254. The piston 254 will be pushed toward the tip side (the nozzle direction) in association with the extending and retracting movement of the crank 251 (movement to the first state). In this way, the cleaning liquid stored in the interior will be jetted onto the endless belt 8 from the nozzle 256. In addition, the piston 254 is drawn toward the rear end side (the opposite direction to the nozzle direction) in association with the extending and retracting movement of the crank 251 (movement to the second state), and in this way the dispensing of the cleaning liquid will be stopped.

A communication port that communicates with the tube is formed, and the cleaning liquid from the sub-tank 50 is introduced into the space formed in the interior of the cylinder 255 by means of the piston 253 and the cylinder 255 via the communication port.

In addition, in the fourth embodiment, the rotator 40 may drive the crank 251, and the sponge member 41 need not be retained opposite the endless belt 8. Thus, the rotator 40 need not be formed into a cylindrical shape that corresponds to the width of the endless belt 8, and may be disk shaped.

Furthermore, an adjustor may be provided that adjusts the installation angle of the sprayer 260 on the cleaning liquid dispenser 255. In this way, the angle of the cleaning fluid conducted from the conduction port can be finely adjusted, which has the effect of allowing cleaning fluid to be jetted in the optimal position in response to an ink removal situation during actual operation.

As described above in the fourth embodiment, cleaning fluid can be intermittently dispensed on the endless belt 8, and dispensed so as to match a flushing region, even by moving the piston 254 by means of the rotational movement of the rotator 40, and jetting the cleaning liquid from the cylinder 255. In addition, according to the fourth embodiment, cleaning liquid can be dispensed on the endless belt 8 without contact, and without employing the sponge member 41. Because of this, there is no need to consider the ink-proof and soil-proof properties of the components of the cleaning liquid dispenser such as the sponge member 41.

Next, a fifth embodiment will be explained with reference to FIG. 15. In the first embodiment, the cleaning liquid dispenser 55 was constructed so that the main tank 51 was arranged above the sub-tank 50, and cleaning liquid is dispensed from the main tank 51 to the sub-tank 50 by means of the head difference between the main tank 51 and the sub-tank 50. Instead of this, the fifth embodiment is constructed so that the cleaning fluid is dispensed from the main tank 51 to the sub-tank 50 by means of a pump 59. Note that the components that are identical to the aforementioned first embodiment have the same reference numerals, and a description thereof will be omitted.

Figure 15:
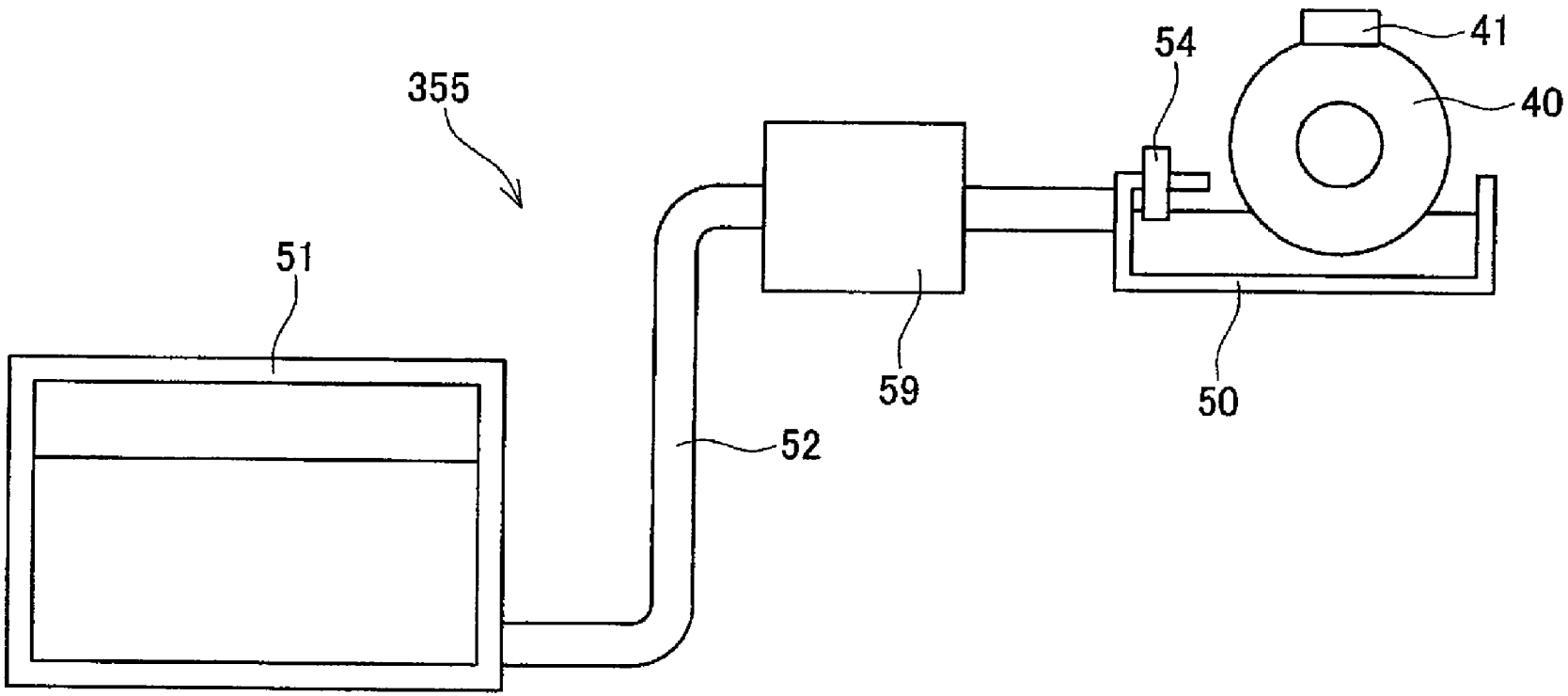
FIG. 15 shows, in frame format, the construction of a cleaning liquid dispenser of a printer in a fifth embodiment.

FIG. 15 shows, in frame format, the construction of a cleaning liquid dispensing unit 355 of the fifth embodiment. The cleaning liquid dispenser 355 of the fifth embodiment comprises a main tank 51 that is below the sub-tank 50. In addition, a pump 59 is arranged along the dispensing tube 52 that connects the main tank 51 and the sub-tank 50 instead of the electromagnetic valve 53. The pump 59 feeds cleaning fluid from the main tank 51, and introduces the cleaning fluid into the sub-tank 50 via the dispensing tube 52. Because of this, when insufficient cleaning liquid is detected by the liquid quantity sensor 54, the pump 59 will be driven for a predetermined time period, and a predetermined quantity of cleaning liquid will be dispensed from the tank 51 to the sub-tank 50.

As described in the fifth embodiment above, because the sub-tank 50 is arranged above the main tank 51, cleaning liquid will be dispensed from the main tank 51 by means of the pump 59. Moreover, because cleaning liquid is not dispensed to the sub-tank so long as it is not fed by a pump, carelessly dispensing the cleaning fluid from the main tank to the sub-tank due to the head difference, and overflowing the cleaning liquid from the sub-tank 50, can be avoided even if the flow path of the cleaning fluid is left open.

The present invention was described above based upon the embodiments, however the present invention is not in any way limited to the aforementioned embodiments. The possibility of various improvements and modifications can be easily imagined within a range that does not depart from the essence of the present invention.

For example, in the aforementioned embodiments, the printer 1 was constructed so as to perform a flushing each time a printing sheet is carried by means of the print process. In other words, in the present embodiments, the print process and the flushing process will be sequentially repeated for one printing sheet. Instead of this, the print process and the flushing process may be sequentially repeated for an n number of printing sheets. Here, n is the integer 2 or higher. A cycle may be repeated in which the flushing process is executed after a print process for n number of printing sheets is continuously executed. In this case, the technology of the present embodiments can be applied as is if the printing sheets are n number of printing sheets that are continued as one quasi-single printing sheet. In this way, the ink quantity and the cleaning liquid quantity that is disposed of during flushing can be reduced, and running costs for maintenance can be controlled.

In addition, in each of the aforementioned embodiments, cleaning fluid was dispensed from below the belt rollers 7*a* to the endless belt 8 by means of the cleaning liquid dispensers 55, 155, 255, 355. However, the position in which the cleaning liquid is dispensed is not limited to these positions, and may be dispensed on the downstream side from the ink jet head 3 in the carry direction, and on the upstream side of the blade 48. In addition, in each of the aforementioned embodiments, one LF motor 29 was made into a common drive source, and the movement period of the endless belt 8 and the rotators (the rotator 40, and the eccentric cam 140) were synchronized. Instead of this, a construction is possible in which a motor other than the LF motor 29 is the drive source used to rotate the rotator, the periods of the movement of the endless belt 8 and the rotator are synchronized, and the period of the rotator is adjusted in accordance with the size of the printing sheet by modulating the output of the motor.

Furthermore, in each of the aforementioned embodiments, the printer 1 was described as a device which uses three different types of printing sheets, A6, A4, and A3. However, the printing sheets used in the printer 1 are not limited to three types, and are not limited to these sizes, and every size of printing sheet can be suitably employed therein. In addition, the printer 1 in each of the aforementioned embodiments knows the position of the rear end of the next flushing region at the time that the reference position of the rotator 40 is detected by the position detection sensor 37, i.e., feed can be executed at an accurate timing by knowing the distance in which the position of the rear end is carried until it arrives at the feed position P1. Thus, the circumferential length of the endless belt 8, the position of the feed position P1 (and the carry distance data based upon the circumferential length of the endless belt 8 and the position of the feed position P1) may be known, and the dimensions of each component of the printer 1 of each of the aforementioned embodiments are not limited to the aforementioned design values.

In addition, in each of the aforementioned embodiments, the flushing region is carried to the surface opposite the inkjet head 3, i.e., the timing of the flushing is recognized by the CPU 20 by detecting the tip of the printing sheet by the paper sensor 31. Instead of this, a construction is possible in which the timing of the flushing is controlled by, for example, measuring the carry distance from the feed position P1 to the fixed position of the ink jet head 3. Methods for measuring the carry distance include storing the number of pulses that correspond to the carry distance in the carry distance counter 30*b*1, and subtracting the output of the pulse signals from the controller 30*b*2 from the number of pulses stored in the carry distance counter 30*b*1; and providing a dedicated counter and a circuit that outputs signals from the clock after a predetermined period of time, storing the time corresponding to the carry distance in the dedicated counter, and subtracting the signal output from the clock from the count value of the counter.

What is claimed is:

1. An ink jet printer comprising:

an endless belt for carrying at least one printing sheet;

a pair of rollers for rotating the endless belt;

an ink jet head for jetting ink towards the printing sheet being carried by the endless belt and towards the endless belt;

a scraper for removing ink adhered to the endless belt;

a cleaning liquid dispenser provided between the ink jet head and the scraper;

a feeder that feeds the printing sheet onto an outer surface of the endless belt, the feeder being activated so that consecutive printing sheets are aligned along the endless belt leaving a gap between the consecutive printing sheets;

a driver that drives the ink jet head to jet ink towards the outer surface of the endless belt at the gap; and a mechanical shifter that moves the dispenser between a first state in which the dispenser supplies the cleaning liquid onto the endless belt and a second state in which the dispenser does not supply the cleaning liquid onto the endless belt, wherein the mechanical shifter is driven in association with the rotation of the endless belt, and the dispenser supplies the cleaning liquid onto the outer surface of the endless belt at the gap.

2. An ink jet printer as defined in claim 1, wherein the mechanical shifter comprises a rotator that rotates in association with the rotation of the endless belt.

3. An ink jet printer as defined in claim 2, wherein the dispenser comprises a cylinder, a piston that slides within the cylinder and a cranking mechanism, and the rotator is coupled to the cranking mechanism.

4. An ink jet printer as defined in claim 1, further comprising:

a sheet sensor that detects whether the printing sheet exists or not at a predetermined position, and wherein the ink jet head is activated based on a detected result by the sheet sensor.

5. An ink jet printer as defined in claim 1, further comprising:

a sheet sensor that detects whether the printing sheet exists or not at a predetermined position, and wherein the feeder is activated based on a detected result by the sheet sensor.

6. An ink jet printer comprising:

an endless belt for carrying at least one printing sheet;

a pair of rollers for rotating the endless belt;

an ink jet head for jetting ink towards the printing sheet being carried by the endless belt and towards the endless belt;

a scraper for removing ink adhered to the endless belt;

a cleaning liquid dispenser provided between the ink jet head and the scraper; and a mechanical shifter that moves the dispenser between a first state in which the dispenser supplies the cleaning liquid onto the endless belt and a second state in which the dispenser does not supply the cleaning liquid onto the endless belt, wherein the mechanical shifter comprises a rotator that rotates in association with the rotation of the endless belt, and a single motor rotates both the endless belt and the rotator.

7. An ink jet printer as defined in claim 6, further comprising:

a speed changer provided between the motor and the rotator, wherein a speed change ratio is switched based on a size of the printing sheet.

8. An ink jet printer as defined in claim 7, wherein the speed changer is selected so that the endless belt runs a predetermined distance while the rotator rotates 360 degrees, the predetermined distance being equal to a sum of a length of the printing sheet and a fixed length.

9. An ink jet printer comprising:

an endless belt for carrying at least one printing sheet;

a pair of rollers for rotating the endless belt;

an ink jet head for jetting ink towards the printing sheet being carried by the endless belt and towards the endless belt;

a scraper for removing ink adhered to the endless belt;

a cleaning liquid dispenser provided between the ink jet head and the scraper; and a mechanical shifter that moves the dispenser between a first state in which the dispenser supplies the cleaning liquid onto the endless belt and a second state in which the dispenser does not supply the cleaning liquid onto the endless belt, wherein the mechanical shifter shifts the dispenser between a first position where the dispenser contacts an outer surface of the endless belt and a second position where the dispenser is separated from the outer surface of the endless belt.

10. An ink jet printer as defined in claim 9, wherein the dispenser contacts the outer surface of the endless belt at a place where an inner surface of the endless belt is supported by one of the rollers.

11. An ink jet printer as defined in claim 9, wherein the dispenser contacts the outer surface of the endless belt at a place where an inner surface of the endless belt is supported by a downstream side roller of the pair of rollers.

12. An ink jet printer as defined in claim 9, wherein the dispenser comprises a porous material that absorbs the cleaning liquid.

13. An ink jet printer as defined in claim 9, wherein the mechanical shifter comprises a cylindrical rotator that rotates in association with a rotation of the endless belt, and the dispenser comprises a porous material extending on a peripheral surface of the cylindrical rotator along a rotating axis of the cylindrical rotator, whereby the porous material intermittently contacts the endless belt due to the rotation of the cylindrical rotator.

14. An ink jet printer as defined in claim 13, further comprising:

a tank for storing the cleaning liquid, wherein the tank is provided below the cylindrical rotator and the porous material is immersed into the cleaning liquid stored in the tank when the porous material is directed to the tank.

15. An ink jet printer as defined in claim 14, further comprising:

a main tank for storing the cleaning liquid, a tube connecting the main tank and the tank, and a valve for opening and closing the tube.

16. An ink jet printer as defined in claim 15, wherein the main tank is positioned above the tank, and the cleaning liquid is transferred from the main tank to the tank due to its gravity.

17. An ink jet printer as defined in claim 15, further comprising:

a pump mounted between the main tank and the tank.

18. An ink jet printer as defined in claim 9, wherein the mechanical shifter comprises a rotating cam, and the dispenser is shifted between the first position and the second position by the rotation of the rotating cam.

19. An ink jet printer comprising:

an endless belt for carrying at least one printing sheet;

a pair of rollers for rotating the endless belt;

an ink jet head for jetting ink towards the printing sheet being carried by the endless belt and towards the endless belt;

a scraper for removing ink adhered to the endless belt;

a cleaning liquid dispenser provided between the ink jet head and the scraper;

a mechanical shifter comprising a rotator that moves the dispenser between a first state in which the dispenser supplies the cleaning liquid onto the endless belt and a second state in which the dispenser does not supply the cleaning liquid onto the endless belt;

an angle detector for detecting a rotating angle of the rotator, and a feeder that feeds the printing sheet onto the outer surface of the endless belt, wherein the feeder is activated based on a timing when the angle detector detects a predetermined angle of the rotator.

20. An ink jet printer as defined in claim 19, wherein the feeder is activated on a timing when the endless belt is rotated for a predetermined distance from a position when the angle detector detected the predetermined angle of the rotator.

21. An ink jet printer as defined in claim 20, wherein the predetermined distance is selected based on a size of the printing sheet.

* * * * *